US010337163B2

(12) United States Patent
MacDonald et al.

(10) Patent No.: US 10,337,163 B2
(45) Date of Patent: Jul. 2, 2019

(54) BLOCKS, BLOCK SYSTEMS AND METHODS OF MAKING BLOCKS

(71) Applicants: Robert A. MacDonald, Plymouth, MN (US); Thomas S. Riccobene, Albuquerque, NM (US)

(72) Inventors: Robert A. MacDonald, Plymouth, MN (US); Thomas S. Riccobene, Albuquerque, NM (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

(21) Appl. No.: 15/793,265

(22) Filed: Oct. 25, 2017

(65) Prior Publication Data

US 2018/0044877 A1 Feb. 15, 2018

Related U.S. Application Data

(63) Continuation of application No. 15/051,055, filed on Feb. 23, 2016, now Pat. No. 9,834,902.
(Continued)

(51) Int. Cl.
*E02D 29/02* (2006.01)
*E04C 1/39* (2006.01)
(Continued)

(52) U.S. Cl.
CPC ..... *E02D 29/025* (2013.01); *B28B 7/0041* (2013.01); *B28B 7/0073* (2013.01);
(Continued)

(58) Field of Classification Search
CPC ..... E04C 1/395; E04C 1/39; E02D 29/025; E02D 29/0266; E04B 2002/0269;
(Continued)

(56) References Cited

U.S. PATENT DOCUMENTS

D884,498 4/1908 King
1,115,542 A 11/1914 Hudson
(Continued)

FOREIGN PATENT DOCUMENTS

CH 406 578 A 1/1966
DE 196 34 499 A1 3/1998
(Continued)

OTHER PUBLICATIONS

Abstract for German Patent No. DE 196 34 499 A1, Mar. 5, 1998 (1 page).
(Continued)

*Primary Examiner* — Carib A Oquendo
(74) *Attorney, Agent, or Firm* — Popovich, Wiles & O'Connell, P.A.

(57) ABSTRACT

A block, block system and method of making a wall block. Multiple block embodiments with multiple embodiments of a visually exposed surface having three dimensional shaped areas and three dimensional angular valleys or joints that can be used to construct a patio, wall, fence or the like; the multiple embodiments creating a more random and natural appearance.

20 Claims, 43 Drawing Sheets

Related U.S. Application Data

(60) Provisional application No. 62/120,438, filed on Feb. 25, 2015.

(51) Int. Cl.

| | |
|---|---|
| ***E04B 2/08*** | (2006.01) |
| ***E04B 2/12*** | (2006.01) |
| ***B28B 7/00*** | (2006.01) |
| ***B28B 7/18*** | (2006.01) |
| ***B28B 7/20*** | (2006.01) |
| ***B28B 7/24*** | (2006.01) |
| *E04B 2/02* | (2006.01) |

(52) U.S. Cl.
CPC ..... *B28B 7/0097* (2013.01); *B28B 7/183* (2013.01); *B28B 7/20* (2013.01); *B28B 7/24* (2013.01); *E02D 29/0266* (2013.01); *E04B 2/08* (2013.01); *E04B 2/12* (2013.01); *E04C 1/39* (2013.01); *E04C 1/395* (2013.01); *E04B 2002/0217* (2013.01); *E04B 2002/0265* (2013.01); *E04B 2002/0269* (2013.01)

(58) Field of Classification Search
CPC ..... E04B 2002/0265; E04B 2/08; E04B 2/12; E04B 2002/0217; B28B 7/0041; B28B 7/0097; B28B 7/20; B28B 7/24; B28B 7/0073; B28B 7/183
USPC ..... 405/284, 286; 52/245, 604, 605
See application file for complete search history.

(56) References Cited

U.S. PATENT DOCUMENTS

| | | | |
|---|---|---|---|
| 2,315,418 | A | 3/1943 | Haaker |
| 2,957,278 | A | 10/1960 | Woodworth |
| 3,220,367 | A | 11/1965 | Stein |
| 4,869,660 | A | 9/1989 | Ruckstuhl |
| 5,161,918 | A | 11/1992 | Hodel |
| 5,252,017 | A | 10/1993 | Hodel |
| 5,490,360 | A | 2/1996 | Fifield et al. |
| 5,588,262 | A | 12/1996 | Dawson |
| D378,702 | S | 4/1997 | Blomquist et al. |
| 5,771,631 | A | 6/1998 | Dawson |
| 6,024,517 | A | 2/2000 | Castonguay et al. |
| D457,982 | S | 5/2002 | Copeland |
| D466,619 | S | 12/2002 | Britton |
| D488,569 | S | 4/2004 | Dawson |
| D500,864 | S | 1/2005 | Klettenberg et al. |
| 6,871,468 | B2 | 3/2005 | Whitson |
| D506,013 | S | 6/2005 | Anderson et al. |
| D506,837 | S | 6/2005 | Scherer et al. |
| D511,578 | S | 11/2005 | Mugge et al. |
| D521,654 | S | 5/2006 | Anderson et al. |
| D529,628 | S | 10/2006 | Mugge et al. |
| 7,140,867 | B2 | 11/2006 | Scherer et al. |
| 7,156,645 | B2 | 1/2007 | Ness |
| 7,175,414 | B2 | 2/2007 | Ness et al. |
| 7,208,112 | B2 | 4/2007 | Scherer |
| 7,261,548 | B2 | 8/2007 | Ness |
| 7,267,321 | B1 | 9/2007 | Morrell |
| D552,258 | S | 10/2007 | Strand et al. |
| D555,810 | S | 11/2007 | Strand |
| D579,576 | S | 10/2008 | Lacas |
| 7,458,800 | B2 * | 12/2008 | Scherer ..... B28B 7/007 425/253 |
| D584,423 | S | 1/2009 | Mugge |
| D584,834 | S | 1/2009 | Lacas |
| D598,136 | S | 8/2009 | Mugge |
| 7,618,578 | B2 | 11/2009 | Manthei et al. |
| D611,164 | S | 3/2010 | Mugge |
| 7,674,420 | B2 | 3/2010 | Johnson et al. |
| 7,687,006 | B2 | 3/2010 | Manthei et al. |
| 7,695,268 | B2 | 4/2010 | Klettenberg |
| 7,740,471 | B2 | 6/2010 | Hoogland |
| D620,614 | S | 7/2010 | Mugge et al. |
| D621,960 | S | 8/2010 | Mugge et al. |
| D625,840 | S | 10/2010 | Mugge |
| 7,849,656 | B2 | 12/2010 | Mugge et al. |
| D632,809 | S | 2/2011 | Mugge et al. |
| D632,810 | S | 2/2011 | Mugge et al. |
| 7,908,799 | B2 | 3/2011 | Mugge et al. |
| D636,093 | S | 4/2011 | Mugge et al. |
| D636,094 | S | 4/2011 | Mugge |
| D638,553 | S | 5/2011 | Mugge et al. |
| D639,455 | S | 6/2011 | Mugge et al. |
| 7,972,128 | B2 | 7/2011 | Mugge et al. |
| D644,747 | S | 9/2011 | Meadows |
| 8,101,113 | B2 | 1/2012 | Castonguay et al. |
| D653,772 | S | 2/2012 | Mugge et al. |
| 8,113,815 | B2 | 2/2012 | Ness et al. |
| 8,268,223 | B2 | 9/2012 | Manthei |
| D678,552 | S | 3/2013 | Mugge et al. |
| D679,833 | S | 4/2013 | Burnquist et al. |
| D685,923 | S | 7/2013 | Mugge et al. |
| 8,540,915 | B2 | 9/2013 | Scherer |
| D690,837 | S | 10/2013 | Mugge et al. |
| D698,041 | S | 1/2014 | Burnquist et al. |
| 8,632,718 | B2 | 1/2014 | Ott |
| D699,866 | S | 2/2014 | Mugge et al. |
| 8,677,711 | B2 | 3/2014 | Wolter et al. |
| 8,715,557 | B2 | 5/2014 | Johnson et al. |
| 8,807,985 | B2 | 8/2014 | Ott |
| 9,021,761 | B2 | 5/2015 | Riccobene et al. |
| D731,675 | S | 6/2015 | Karau |
| 2002/0083657 | A1 | 7/2002 | Mattox et al. |
| 2003/0007834 | A1 | 1/2003 | Boldue et al. |
| 2003/0126821 | A1 | 7/2003 | Scherer et al. |
| 2003/0164574 | A1 | 9/2003 | Hammer et al. |
| 2003/0182011 | A1 | 9/2003 | Scherer |
| 2004/0088929 | A1 | 5/2004 | Dawson et al. |
| 2005/0211871 | A1 * | 9/2005 | Ness ..... B28B 7/0014 249/140 |
| 2006/0249881 | A1 | 11/2006 | Castonguay et al. |
| 2008/0092870 | A1 | 4/2008 | Karau et al. |
| 2008/0258340 | A1 | 10/2008 | Klettenberg |
| 2009/0000233 | A1 | 1/2009 | Hammer |
| 2009/0103987 | A1 | 4/2009 | MacDonald |
| 2009/0249734 | A1 | 10/2009 | Karau |
| 2011/0316194 | A1 | 12/2011 | Manthei |
| 2014/0237926 | A1 | 8/2014 | MacDonald et al. |
| 2014/0270988 | A1 | 9/2014 | Riccobene et al. |

FOREIGN PATENT DOCUMENTS

| | | |
|---|---|---|
| GB | 2 236 778 A | 4/1991 |
| JP | 2008 114497 A | 5/2008 |

OTHER PUBLICATIONS

Abstract for JP 2008 114497 A (2 pages).
Dec. 15, 2014 PCT Invitation to Pay Additional Fees and, Where Applicable, Protest Fee for International Application No. PCT/US2014/057644 (6 pages).
May 9, 2016 PCT Notification of Transmittal of the International Search Report and the Written Opinion for International Application No. PCT/US2016/019141 (13 pages).

* cited by examiner

BLOCKS, BLOCK SYSTEMS AND METHODS OF MAKING BLOCKS

This application is a continuation of U.S. Ser. No. 15/051,055, filed Feb. 23, 2016, which claims the benefit of U.S. Provisional Application No. 62/120,438, filed Feb. 25, 2015, the contents of each of which are hereby incorporated by reference herein.

FIELD OF THE INVENTION

This invention relates generally to blocks, edger blocks, retaining walls, walls and fences constructed from the blocks. This invention also relates to the method of manufacturing the block and the methods of constructing structures with the blocks. This invention also relates to mold boxes, mold liners and stripper shoes used in the manufacture of the blocks.

BACKGROUND OF THE INVENTION

Retaining walls, walls, and fences are used in various landscaping projects and are available in a wide variety of styles. Numerous methods and materials exist for the construction of patios, fences, edgers, walls and retaining walls. Such methods include the use of natural stone, poured concrete, precast panels, masonry, and landscape timbers or railroad ties.

In recent years, segmental concrete wall and landscaping units, which may be laid, positioned or dry stacked without the use of mortar or other complex securing means, have become widely accepted in the construction of patios, fences, walls and retaining walls. Such patio, wall and landscaping units have gained popularity because they are mass produced and, consequently, relatively inexpensive. They are structurally sound, easy and relatively inexpensive to install, and couple the durability of concrete with the attractiveness of various architectural finishes.

In the manufacture of patio, wall and landscaping blocks and other kinds of blocks made from concrete, it is common to use a mold that forms a block module which is then split to form two or more blocks. In another method, blocks are individually formed in a mold and the surfaces are textured by the mold and the removal of the mold exposes these surfaces. Another known method of creating a block having an irregular or textured surface is to form the block in a mold box that has been provided with a sidewall liner or stripper shoe shaped to impart the irregular or textured surface on the block during the block molding process.

In the construction of a wall or fence the aesthetic design of the individual block units and the overall visually pleasing aesthetic appearance of the patio, wall or fence is very desirable. Blocks that have a desirable texture or pattern create an exposed surface of a patio, wall or fence that is visually appealing. Such blocks are commonly made in a block machine which includes a mold assembly comprising one or more mold cavities. A texture or pattern may be imparted to a surface of the block by a stripper shoe or side liner of the mold assembly. For example, if the exposed surface of the block is formed at the top of the mold cavity a texture or pattern may be imparted to the block surface by a stripper shoe and if the exposed surface of the block is formed at a side of the mold cavity the texture or pattern may be imparted to the block surface by a side liner of the mold. Typically, the blocks are formed of a moldable material comprising dry cast concrete. The use of dry cast concrete presents some issues for prior art mold assemblies when making blocks having a textured or patterned surface. If the pattern is to be impressed on a block surface by a side liner of the mold assembly the patterned surface may sag when the dry cast concrete is discharged from the mold if the pattern includes contours which leave part of the surface unsupported. If the pattern is to be formed on a block surface by the stripper shoe the patterned surface may not properly release from the stripper shoe if the pattern does not have a sufficient release taper or heated shoes. Therefore, it would be desirable to provide a block having a desired texture or pattern on an exposed surface and a mold assembly capable of making the block while overcoming the problems of prior art mold assemblies.

It would further be desirable to provide a block having a desired texture or pattern on an exposed surface that could be used in the construction of walls that are straight, irregularly contoured, convexly curved or concavely curved. It would further be desirable to provide the same block with the ability to be used in the construction of the main building courses of the structure and as a capping or finishing course of the structure constructed with the block.

SUMMARY OF THE INVENTION

Disclosed herein are various wall blocks and block systems used to construct a wall or other desired structure having a straight and/or irregular or curved contour. The blocks may be configured to be used in both the main building courses of the structure and the capping or finishing course of the structure. Also disclosed herein are mold assemblies for producing the blocks. The front faces of the blocks may be molded with compound features that enhances the three dimensionality of the front face. The blocks, block systems, mold assemblies and methods disclosed herein are not intended to be limited to a particular size, shape or feature and, as such, the blocks, block systems, mold assemblies and methods may contain any or all features disclosed herein. Further, the concepts and features disclosed herein are equally applicable to blocks formed from a dry cast or a wet cast process. Additionally, the following summary is intended only as a broad overview and is not intended to identify or limit critical features of the inventions disclosed herein.

A wall block including a block body having opposed front and rear faces, opposed and substantially parallel top and bottom surfaces, and opposed first and second side walls. The wall block being further configured to have any or all additional features described herein.

The wall block may be configured such that the first and second side walls may each have a first portion extending from the front face to the rear face and a second portion extending from the front face to the rear face, the first and second portions of the first and second side walls may be vertically planar. The first portion of the first side wall and the first portion of the second side wall may be orthogonal to the rear surface and the second portion of the first side wall and the second portion of the second side wall may be non-orthogonal to the rear surface.

The wall block may be alternatively configured such that the first side wall has a first portion extending from the front face to the rear face and a second portion extending from the front face to the rear face, the first and second portions of the first side wall are vertically planar. The first portion of the first side wall and the second side wall may be orthogonal to the rear surface and the second portion of the first side wall may be non-orthogonal to the rear surface.

The wall block may be optionally configured such that the first and second side walls have a first portion extending from the front face to the rear face and a second portion extending from the front face to the rear face, the first and second portions of the first and second side walls are vertically planar. The vertically planar first portion of the first side wall may be parallel to the vertically planar first portion of the second side wall and the vertically planar second portion of the first side wall may converge towards the vertically planar second portion of the second side wall from the front face toward the rear face of the block body.

The wall block may be optionally configured such that the first side wall of the wall block has a first portion extending from the front face to the rear face and a second portion extending from the front face to the rear face, the first and second portions of the first side wall being vertically planar. The vertically planar first portion of the first side wall may be parallel to the vertically planar second side wall and the vertically planar second portion of the first side wall may converge towards the vertically planar second side wall from the front face toward the rear face of the block body.

The wall block may be alternatively configured such that the first side wall may have a groove and the second side wall may have a projection. The groove of the first side wall may have a vertically planar surface that converges into the block body at an angle from the front face toward the rear face of and the projection of the second side wall may have a vertically planar surface that extends outward from the block body at an angle. The vertically planar surface of the groove may be parallel to the vertically planar surface of the projection.

The wall block may be alternatively configured such that the bottom surface may have at least a first groove. The at least one groove of the bottom surface may extend a depth into the block body from a position along the first side wall to a position along the rear face, the at least one groove of the bottom surface converging from the first side wall towards the second side wall.

A block system including a plurality of blocks having a block body with opposed front and rear faces, opposed and substantially parallel top and bottom surfaces, and opposed first and second side walls. The block system being further configured to have any or all additional features described herein.

The block system may be configured such that the first and second side walls of the plurality of blocks each have a first portion extending from the front face to the rear face and a second portion extending from the front face to the rear face. The first and second portions of the first and second side walls may be vertically planar, the vertically planar first portion of the first side wall may be parallel to the vertically planar first portion of the second side wall and the vertically planar second portion of the first side wall may converge towards the vertically planar second portion of the second side wall from the front face toward the rear face of the block body. The front face may have a first undercut portion adjacent the top surface and a second undercut portion adjacent the bottom surface, the first and second undercut portions may be separated by a molded surface having an irregular contour which is non-planar horizontally and vertically. The blocks may be configured such that when the blocks are stacked in at least first and second courses to form a wall having a vertical configuration or a setback from course to course, in a top view of the wall the top planar surface of blocks in the first course may not be exposed.

The block system may be optionally configured such that the first and second side walls of the plurality of wall blocks each have a first portion extending from the front face to the rear face and a second portion extending from the front face to the rear face, the first and second portions of the first and second side walls may be vertically planar. The vertically planar first portion of the first side wall may be adjacent the bottom surface and parallel to the vertically planar first portion of the second side wall adjacent the bottom surface and the vertically planar second portion of the first side wall may be adjacent to the top surface and may converge towards the vertically planar second portion of the second side wall adjacent the top surface. The blocks may be configured such that when the blocks are stacked with the top surface facing upward the upper surface of the block has a trapezoidal shape and such that when the blocks are stacked with the bottom surface facing upward the upper surface of the block has a rectangular shape.

A mold assembly for producing wall blocks having a block body with opposed front and rear faces, opposed and substantially parallel top and bottom surfaces, and opposed first and second side surfaces. The mold assembly being further configured to mold any or all additional features described herein.

The mold assembly may be configured such that the first and second side surfaces of the block produced in the mold each have a first portion extending from the front face to the rear face and a second portion extending from the front face to the rear face, the first and second portions of the first and second side surfaces may be vertically planar. The first portion of the first side surface and the first portion of the second side surface may be orthogonal to the rear surface and the second portion of the first side surface and the second portion of the second side surface may be non-orthogonal to the rear surface. The mold assembly may include a production pallet; a stripper shoe; and a mold box including first and second opposed side walls that are moveable from a disengaged mold stripping position to an engaged molding position during a block forming process, and opposed front and rear walls which together with the first and second side walls form a perimeter of at least one mold cavity shaped to form a block during a block forming process. The mold box may have an open top and an open bottom with the production pallet enclosing the open bottom of the mold box during a block forming process. The stripper shoe may enclose at least a portion of the open top of the mold box during a block forming process and may have a contoured molding surface shaped for forming at least a portion of the front face of a block. The moveable first and second opposed side walls may have an angular planar molding surface that converges from the mold cavity top toward the mold cavity bottom, and the moveable first and second side wall may have a vertically planar molding surface that is parallel to the front and rear wall of the mold cavity.

BRIEF DESCRIPTION OF THE DRAWINGS

The various embodiments of the present invention will now be described by way of example with reference to the accompanying drawings, wherein.

DETAILED DESCRIPTION OF THE PREFERRED EMBODIMENTS

In this application, the term "block" refers to bricks, blocks, stones, or other three dimensional objects that can be used in the construction of walls, retaining walls, columns or other structures, including interior and exterior structures and including load bearing and non-load bearing structures. Therefore, although all of the block embodiments described herein are directed to wall blocks it should be understood that the inventive concepts included herein apply to all types of blocks and are not limited to wall blocks.

In forming a wall, one row of blocks is laid down, forming a course. A second course is laid on top of this by positioning the lower surface of one block on the upper surface of another block. It should be understood that lower surface and upper surface may refer to either the top surface or bottom surface of the block such that whichever surface is facing downward becomes the lower surface and whichever surface is facing upward becomes the upper surface. The blocks may or may not be provided with pin holes and pin receiving cavities. The blocks may or may not also be provided with a receiving channel. The location, shape, and size of the optional pin holes, pin receiving cavities, and receiving channels are selected to maximize the strength of the block, as described by reference to the drawings. It should be understood, however, that use of a pin connection system or clip connection system for the blocks is not limiting and other types of connection methods are within the scope of the present invention.

Figure 39:
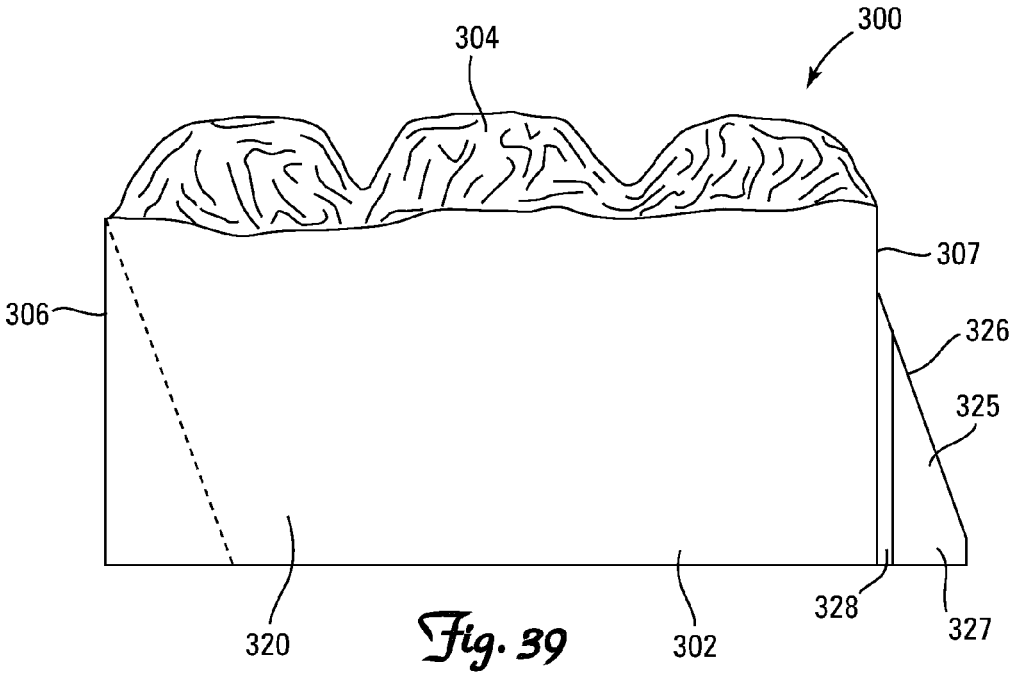
FIGS. 39, 40 and 41 are top, rear and side perspective views of third bock embodiment 300.
Figure 40:
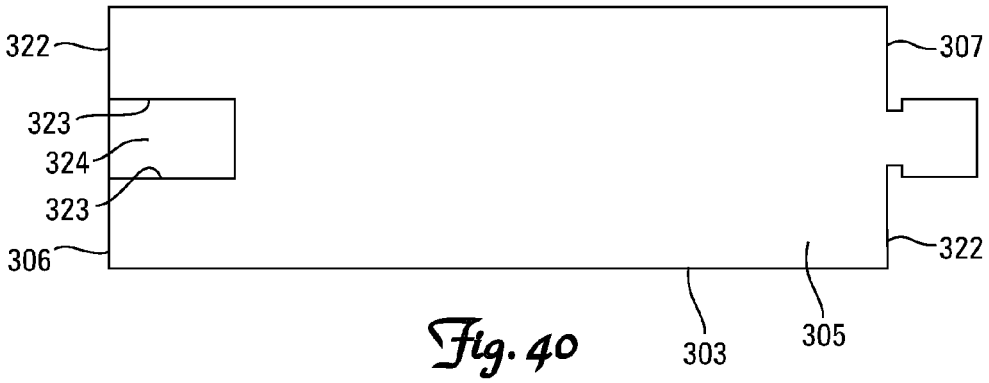
Figure 41:
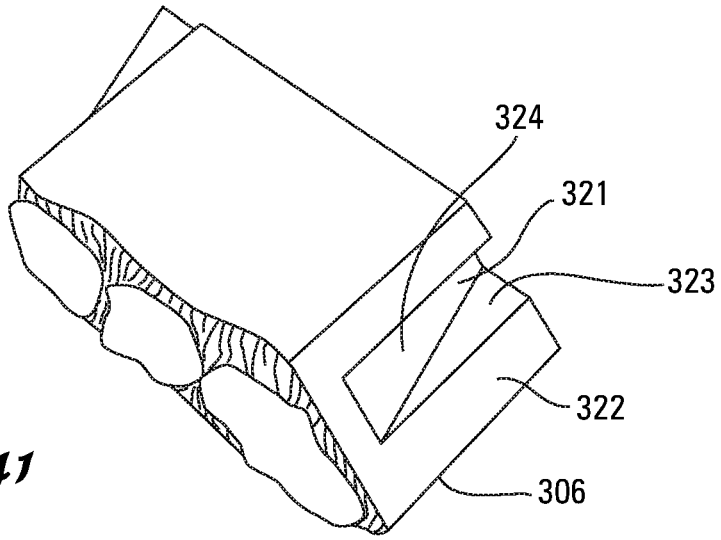
Figure 48:
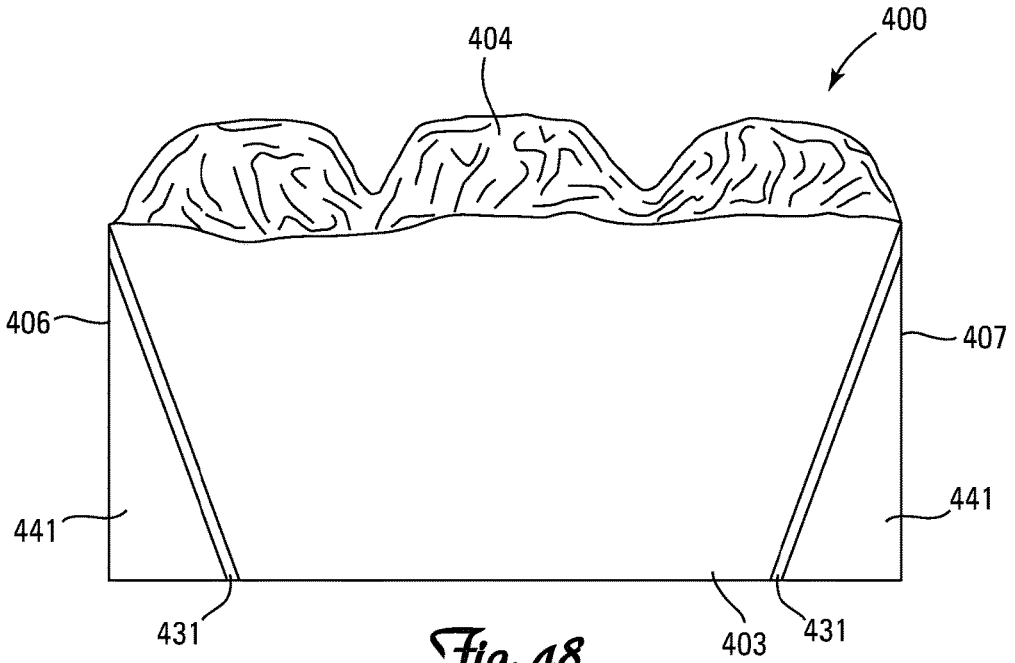
FIGS. 48 and 49 are top and rear views of alternate fourth bock embodiment 400.
Figure 49:
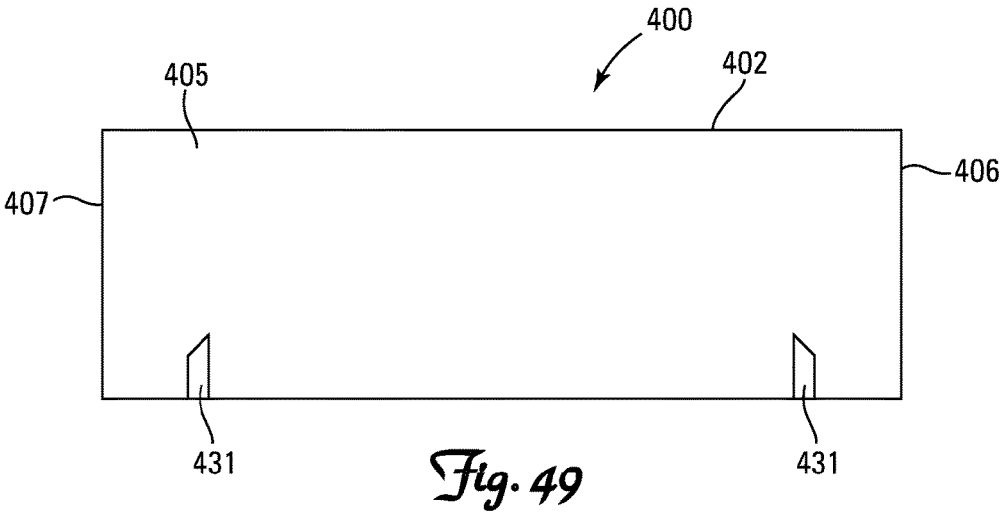

Disclosed herein are multiple embodiments of a wall block which can be used to construct walls, including retaining walls. Specifically, FIGS. 1 to 8 show a first embodiment of the block, FIGS. 30 to 38 show a second embodiment of the block, FIGS. 39 to 41 show a third embodiment of the block and FIGS. 48 and 49 show a fourth embodiment of the block. Also disclosed herein are mold systems and methods of making the block embodiments in mold cavities with the front face of the blocks positioned at the top of the mold cavities and the rear face of the blocks positioned at the bottom of the mold cavities. FIGS. 59 to 75 and 78 show various molds and molding surfaces used to form the block embodiments The first embodiment of the wall block is shown in FIGS. 1 to 8 which are perspective, front, back, side, top side perspective, bottom side perspective, top and bottom views, respectively, of a block 100. As will be described in more detail hereafter FIGS. 9 to 29 show various features and alternative configurations of block 100. Block 100 is made of a rugged, weather resistant material; preferably (and typically) zero-slump molded concrete. Other suitable materials include wet-cast concrete, plastic, concrete with fiber reinforcing, composite polymers, and any other moldable material. Block 100 has parallel top surface 102 and bottom surface 103, front face 104, rear face 105 and compound first and second side wall surfaces 106 and 107. Front face 104 and rear face 105 extend from top face 102 to bottom face 103.

Figure 4:
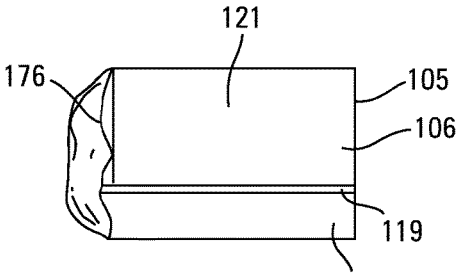
Figure 5:
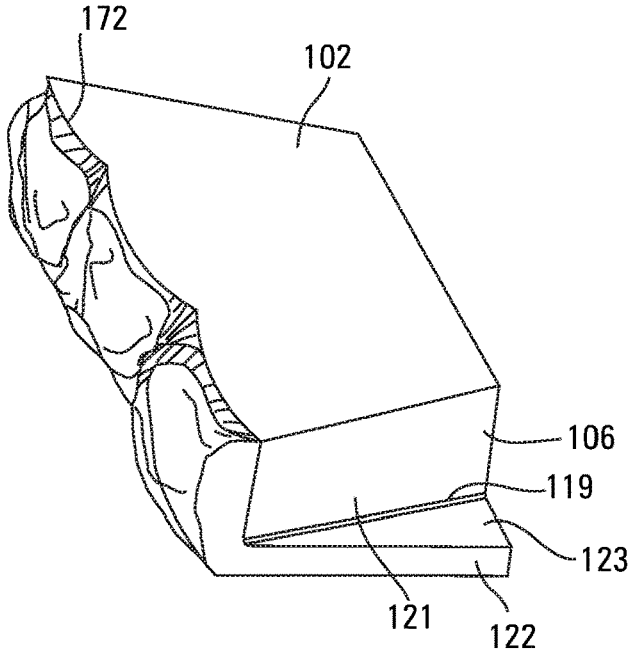
Figure 6:
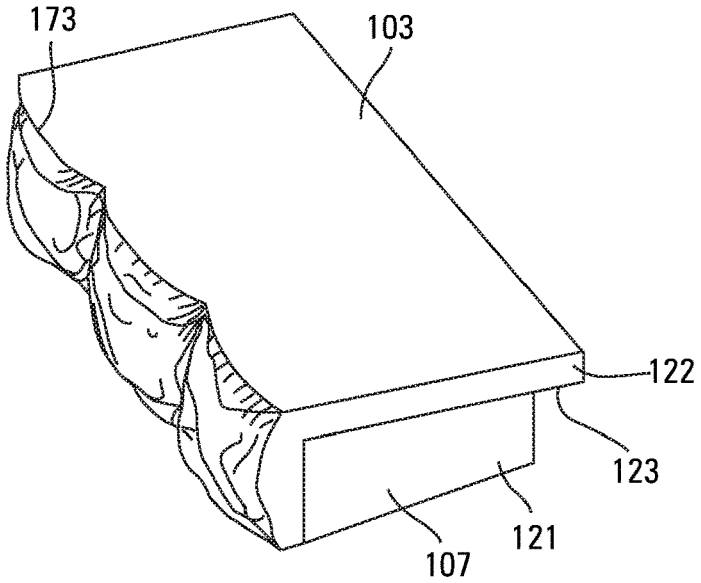
Figure 7:
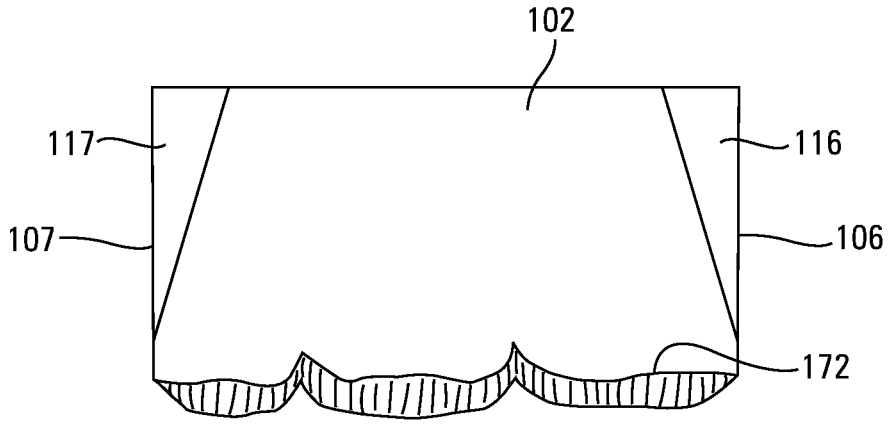
Figure 8:
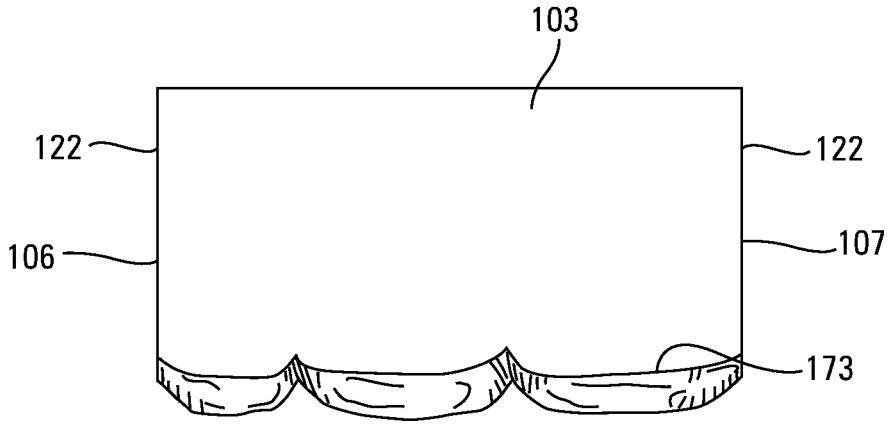

Side walls 106 and 107, shown in detail in side and side perspective views in FIGS. 4 to 6, extend from top surface 102 to bottom surface 103, and each have an angular planar surface 121 that converges from front face 104 toward rear face 105. Angular planar surfaces 121 are non-orthogonal to front face 104 and rear face 105 and are orthogonal to top surface 102. As shown in the top view of block 100 in FIG. 7, the convergent angular planar surfaces 121 of side walls 106 and 107 give top surface 102 a trapezoidal shape such that the width (as measured from side surface to side surface) of top surface 102 toward front face 104 is greater than the width of top surface 102 toward rear face 105. As such, the total surface area of top surface 102 is trapezoidal. Side walls 106 and 107 also each have vertical planar surface 122 extending from front face 104 to rear face 105, the vertical planar surface 122 of side wall 106 being parallel to the vertical planar surface 122 of side wall 107. Vertical planar surfaces 122 of side walls 106 and 107 are generally orthogonal to rear face 105 and may also be orthogonal to front face 104. Vertical planar surfaces 122 are also orthogonal to bottom surface 103. As can be seen in the bottom view of block 100 in FIG. 8, parallel vertical planar surfaces 122 of side walls 106 and 107 give bottom surface 103 a rectangular shape such that the width (as measured from side surface to side surface) of bottom surface 103 toward front face 104 is substantially equal to the width of bottom surface 103 at rear face 105. As such, the total surface area of bottom surface 103 is rectangular. As can be seen in FIGS. 7 and 8, the total surface area of the trapezoidal top surface is less than the total surface area of the rectangular bottom surface.

Side walls 106 and 107 also have horizontal planar surface 123 that extends from angular planar surface 121 to vertical planar surface 122; horizontal planar surface 123 being parallel to the horizontal planar surfaces of top surface 102 and bottom surface 103. In FIGS. 1 to 8, angular planar surfaces 121 are shown as extending more than half the height or distance of side walls 106 and 107 from the top surface toward the bottom surface and vertical planar surfaces 122 are shown as extending less than half the height or distance of side walls 106 and 107 from the bottom surface toward the top surface. It should be understood that the dimensions of angular planar surfaces 121 and vertical planar surface 122 are not limiting and can be any desired dimension and, as such, the angular planar surfaces and vertical planar surfaces could each extend half the height or distance of side walls 106 and 107.

The blocks illustrated in the FIGS. 1 to 8 may have various dimensions. In one embodiment block 100 has a height (i.e., the distance between surfaces 102 and 103) of about 4 inches (102 mm), a body length (i.e., the distance from side wall 106 to side wall 107) of about 12 inches (304 mm) and a width (i.e., the distance from front face 104 to rear face 105) of about 7 inches (178 mm) It should be understood, however, that regular or commercial building blocks may be much larger (or smaller) and are included within the scope of this invention.

Figure 3:
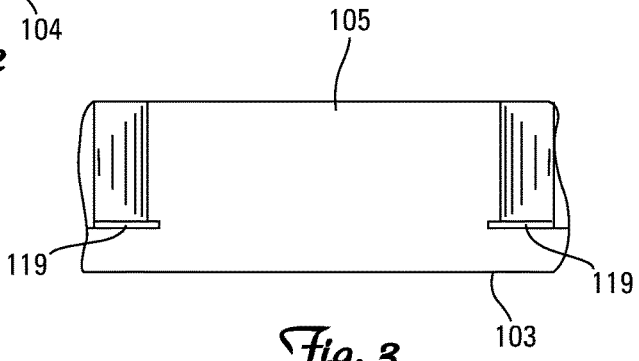
Figure 9:
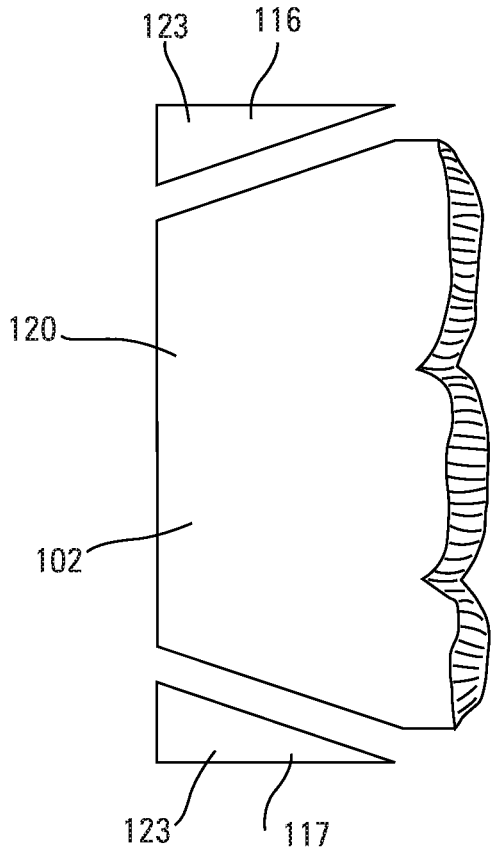
FIG. 9 is a top view of the block body and removed wing portions of the block embodiment of FIGS. 1 to 8.

FIG. 9 shows block body 120 formed from top surface 102, bottom surface 103, front face 104, rear face 105 and angular planar surfaces 121 of side walls 106 and 107. FIGS. 7 and 9 show horizontal planar surface 123 of side wall 106, the area of bottom surface 103 located directly below horizontal planar surface 123 and vertical planar surface 122 of side wall 106 form side wing 116. Horizontal planar surface 123 of side wall 107, the area of bottom surface 103 located directly below horizontal planar surface 123 and vertical planar surface 122 of side wall 107 form side wing 117. One or both of side wings 116 and 117 may be cut, broken or in some other way generally removed from block body 120 during construction of a wall or other structure when necessary or desired and as discussed further below. Side wings 116 and 117 may be molded with breakaway groove 119, as seen in FIGS. 3 and 5, that aids in removing side wings 116 and 117 from block body 120 and also helps provide for cleaner and more controlled break. Removing at least one of side wings 116 and/or 117 from block body 120 allows block 100 to be used in the construction of convex shaped portions of walls or other structures.

It should be understood that block 100 may be molded without one or both wings 116, and 117. With this configuration of block 100, one or both of side wall surfaces 106/107 would extend substantially vertically between the top and bottom surfaces of block 100 and intersect the rear face at an angle which is not orthogonal.

Figure 10:
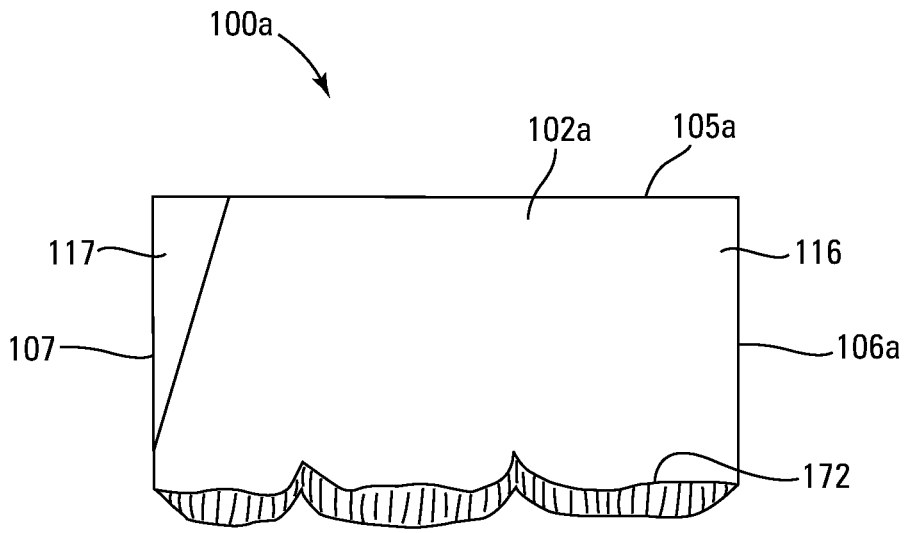
FIGS. 10 and 11 are top and bottom views of an alternate embodiment of the block of FIGS. 1 to 8.
Figure 11:
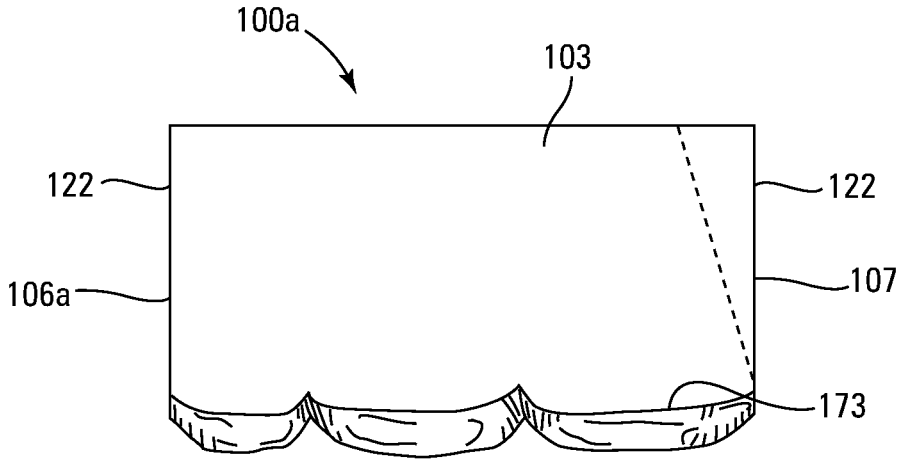

An alternate configuration of block 100 is shown in FIGS. 10 and 11. Features of this configuration which are the same or substantially the same as in block 100 are identified by the same reference numerals used to describe block 100. Features which are different from block 100 are described below and are identified with different reference numerals. FIGS. 10 and 11 show block **100*a* which has a structure similar to block 100 except that side wall surface 106*a* extends substantially vertically between the top surface 102*a* and bottom surface 103 of block 100*a*. This side wall surface 106*a* intersects rear face 105*a* at an angle which is orthogonal to the rear face. Side wall surface 106*a* of block 100*a* may be molded with a similar texture or pattern as the front face of block 100 by a side liner that imparts the texture or pattern onto side surface 106*a*. The texture or pattern that is molded onto the front face and side surface 106*a* may have any desired texture or pattern and be may substantially similar to any of the textures or patterns disclosed herein. Further, the texture or pattern that is molded onto the front face and side surface 106*a* gives a texture or pattern on two surfaces of the block and, as such, allows block 100*a* to be used as a corner block in the construction of a wall or structure having a corner with two visual or exposed surfaces. FIG. 11 illustrates the positioning of the angular surface 121 and breakaway wing 117 relative to the bottom surface of block 100*a***.

Figure 1:
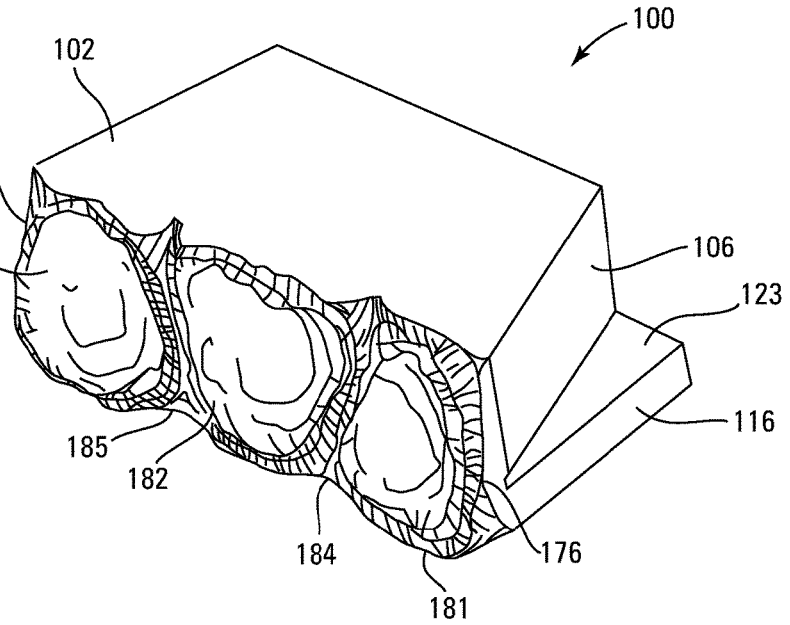
FIGS. 1, 2, 3, 4, 5, 6, 7 and 8 are perspective, front, back, side, top side perspective, bottom side perspective, top and bottom views, respectively, of an embodiment of a block.
Figure 2:
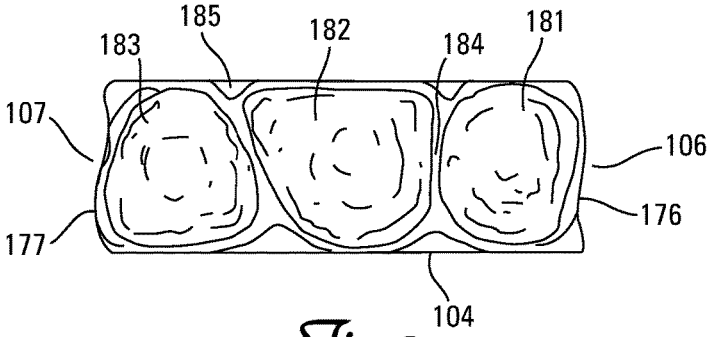

As seen in FIGS. 1 and 2 front face 104 has an irregularly contoured surface extending from top surface 102 to bottom surface 103 and from side wall 106 to side wall 107. The compound shape of front face 104 has areas that protrude outward from top and bottom surfaces 102 and 103, respectively, in a direction generally away from block body 120 and additionally may have areas that extend into the block body 120 towards rear surface 105 of the block. It should be understood that front face 104 could have any shape, pattern or texture as desired and could be substantially flat or planar. As shown in FIG. 5, the forming stripper shoe that molds front face 104 may also create an irregular contoured front edge 172 along top surface 102. Edge 172 separates top surface 102 from front face 104. Edge 172 lies in the same horizontal plane as top surface 102 but its distance from rear face 105 varies such that edge 172 lies in more than one vertical plane. It should be understood that edge 172 is not limiting and could have any desired contour and could, for example, be in the same horizontal plane and same vertical plane. As best seen in FIG. 6, the forming stripper shoe that molds front face 104 may also create an irregular contoured edge 173 along bottom surface 103. Edge 173 is the boundary separating bottom surface 103 from front face 104. Edge 173 lies in the same horizontal plane as bottom surface 103 but its distance from the rear face 105 varies such that edge 173 lies in more than one vertical plane. It should be understood that the shape of edge 173 is not limiting and could have any desired contour.

Figure 21:
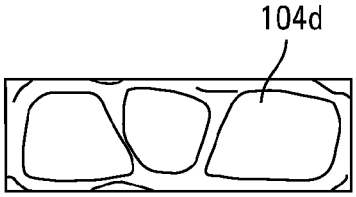
Figure 22:
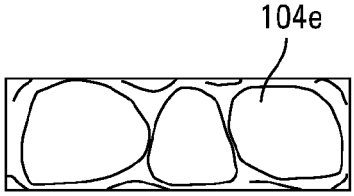

The forming stripper shoe also creates irregularly contoured ends or edges 176 and 177 which are the junctions of side wall 106 and front face 104 and side wall 107 and front face 104, respectively. As can be seen in FIGS. 1 and 2, edges 176 and 177 extend from top surface 102 to bottom surface 103. Edges 176 and 177 may have various irregular contours or shapes and may follow the irregular contour of the side ends of front face 104. The forming stripper shoe may be additionally configured to impart a desired texture onto portions of side walls 106 and 107 in the mold cavity. Thus, the irregularly textured surface of front face 104 adjacent side walls 106 and 107 can form a continuous irregularly textured contoured area that includes a portion of the side wall, the side edge, and the front side end of the front face. Additionally and/or alternatively, if the side ends of front face 104 are substantially planar, vertical edges 176 and 177 may be substantially planar as seen in FIGS. 21 and 22. The distance of edges 176 and 177 to the rear face and to one another may vary between the top and bottom surfaces depending upon the contour of the edges. It should be understood that edges 176 and 177 are not limiting and could have any desired contour.

As best seen in FIGS. 1 and 2, front face 104 has shaped areas 181, 182 and 183 that are three dimensional and are molded to have the irregular appearance of natural stone. The multiple shaped areas with natural stone-like appearance are molded onto the block by a forming stripper shoe during the molding process and are designed to have degrees of sloping that will allow the molded front face to be stripped from the forming stripper shoe after completion of the molding process. Shaped areas 181, 182 and 183 may be positioned lower than/beneath upward facing top surface 102 and/or higher than/above bottom surface 103. Shaped areas 181, 182 and 183 may extend outwardly from top surface 102 and bottom surface 103 and may have irregular sloping surfaces. Each shaped area may have an irregularly contoured surface that gives a more pleasing visual aesthetic as well as more accurately imitates the irregular contoured surfaces of natural stone. Any of the shaped areas could also be molded to have inward extending fissure surfaces to mimic natural stone. Other three dimensional surface detail may be molded into any of the shaped areas, including chips, notches grooves, false joints to further add contour and additional dimension and to also create further shadowing across the front surface of the block. It should be understood that front face 104 could have any desired number of shaped areas and that the shaped areas could be any desired size or shape. Additionally, the shaped areas may have surfaces that extend outward (or project inward) from the top and bottom surfaces at any desired dimension or angle.

Shaped areas 181 and 182 are separated by valley or joint 184. Shaped areas 182 and 183 are separated by valley or joint 185. Valleys 184 and 185 may extend into the block body any dimension desired. For example, valleys 184 and 185 may extend into the block body at varying dimensions along front face 104 and may extend into the block body up to ⅔rds or more of the unit height of the block as installed (the distance from top surface 102 to bottom surface 103). It should be understood that this value is not limiting and thus valleys 184 and 185 may extend into the block body at any dimension as desired. Valley or joint 184 has an angular slope from the bottom surface of the block towards the top surface and could have any degree of slope as desired. The slope of valley or joint 184 creates further shadowing effects towards the bottom surface of the block that enhances the visual aesthetic of the block and gives the block a more natural stone-like appearance. Valley or joint 185 has a slope that may angle away from the angular slope of valley 184 from the bottom surface to the top surface. Valleys 184 and 185 each have a width that can widen and narrow along its irregular angular contour.

As can be seen in FIG. 2, the lower portion of valley 184 flares out or widens towards the bottom surface of block 100. Additionally, the upper portion of valley also widens or flares towards the parting line of the front face. This type of contour projects a shadowing effect on the front surface of the block that enhances the three dimensional aesthetic of the block; giving block a more natural stone-like appearance. The sides of shaped areas may form the side surfaces of the valley or joints and may have contours that arc or slope into the valleys or joints. The amount of arc or slope is not limiting and thus sides of the shaped areas may arc or slope into the valleys or joints at any desired dimension.

It should be understood that the number, location and dimensions of valleys or joints are not limiting and front face 104 could, therefore, have any number, location or dimension of valley or joints as desired. Further, the valley or joints could have any desired degree of slope. It should further be understood that shaped areas 181, 182 and 183 could contain false joints that may be much shallower than valley or joints 184 and 185 and may be entirely contained within an individual shaped area.

Figure 12:
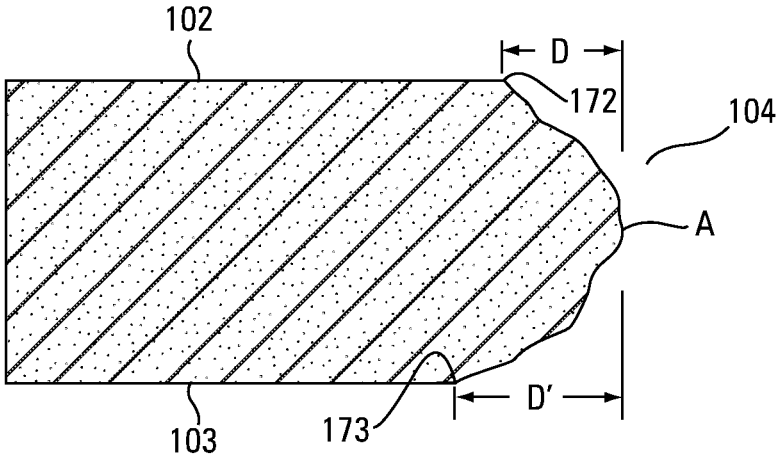
FIGS. 12 and 13 are side cross sectional views of the embodiment of FIGS. 1 to 8 showing the depth of the front face from a point along the top edge and bottom edge.
Figure 13:
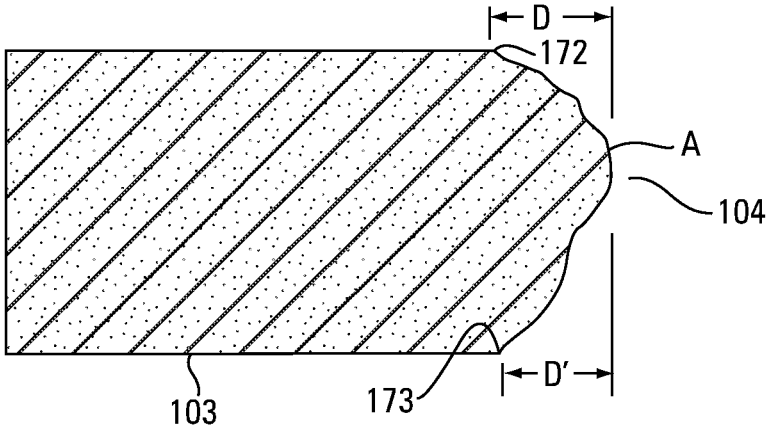

Front face 104 has apex points A along the length of the front face that are defined as the most outwardly extending point along front face 104 (and shaped areas 181, 182 and 183) from block body 120 in a vertical plane that is perpendicular to the vertical plane of rear face 105. FIGS. 12 to 15 are cross-sectional views of block 100 along vertical planes perpendicular to rear face 105 showing examples of the cross-sectional shape of front face 104 and the location and position of point A. As shown in FIGS. 12 and 13, front face 104 has a depth D which is the distance from a location along edge 172 to apex point A in the same vertical plane perpendicular to rear face 105. Depth D may have varying dimensions along front face 104 and in the multiple shaped areas that may be up to ⅔rds or more of the unit height of the block as installed (the distance from top surface 102 to bottom surface 103). It should be understood that this range is not limiting and could be any dimension as desired. As shown in FIGS. 12 and 13, front face 104 has a depth D' which is the distance from a location along edge 173 to apex point A at a location along front face 104 and the shaped areas that is in the same vertical plane perpendicular to rear face 105. Depth D' may have varying dimensions along front face 104 and may be up to ⅔rds or more of the unit height of the block as installed (the distance from top surface 102 to bottom surface 103). It should be understood that this range is not limiting and could be any dimension as desired. Further, depth D may have a different dimension than depth D' at the same apex point A along front face 104 as illustrated in FIG. 12. Still further yet, depth D may have the same dimension as the dimension of depth D' at the same apex point A along front face 104 as in FIG. 13.

Figure 14:
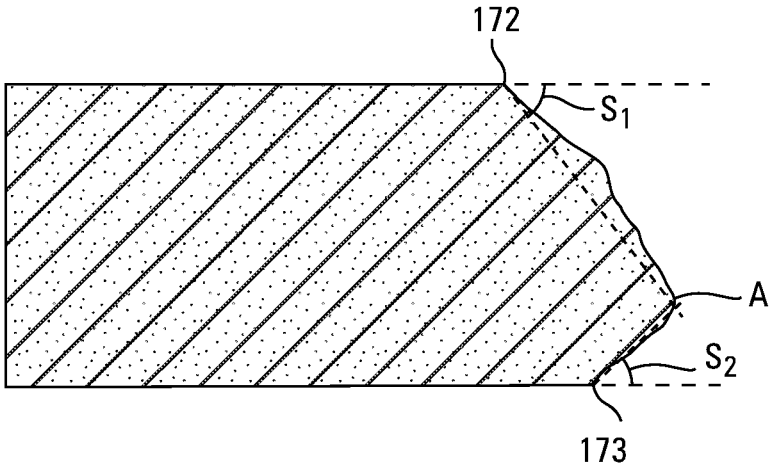
FIGS. 14 and 15 are side cross sectional views of the downward slope and upslope of the front face from a point along the top edge and bottom edge.
Figure 15:
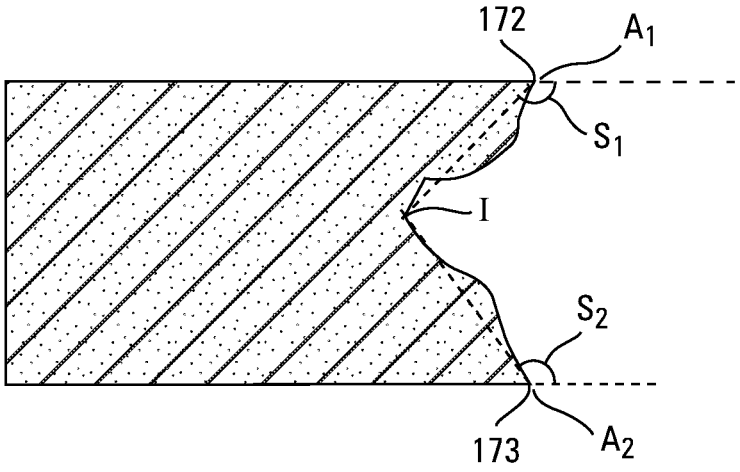

As shown in FIG. 14, the irregular contoured surface of front face 104 may have an averaged downward slope $S_1$ from a location along edge 172 of horizontally planar top surface 102 to apex point A. Degrees of downward slope located from the horizontal plane of top surface 102 at edge 172 to apex point A at locations along front face 104 may be in the range of 0° to 90°. Additionally, there may be locations along front face 104 where edge 172 comprises a first apex point A1 and the downward slope exceeds 90° by extending inwardly along the valleys of the front face from edge 172 into block body 120 toward rear face 105 as can be seen in FIG. 15. In this circumstance, the averaged degree of downward slope located from the horizontal plane of top surface 102 at edge 172 to the most inwardly extending point I at locations along front face 104 may be in the range of 90° to 135°.

FIG. 14 shows that the irregular contoured surface of front face 104 may have an averaged upward slope $S_2$ from a location along edge 173 of horizontally planar bottom surface 103 to apex point A. Degrees of upward slope located from the horizontal plane of bottom surface 103 at edge 173 to apex point A at locations along front face 104 (and shaped areas 181, 182 and 183) may be in the range of 0° to 90°. Additionally, as shown in FIG. 15, there may be locations along front face 104 such as the valley adjacent to the shaped areas where edge 173 comprises a second apex point A2 and the upward slope exceeds 90° by extending inwardly from edge 173 into block body 120 toward rear face 105. In this circumstance, the averaged degree of upward slope located from the horizontal plane of bottom surface 103 at edge 173 to the most inwardly extending point I at locations along front face 104 may be in the range of 90° to 135°.

Figure 16:
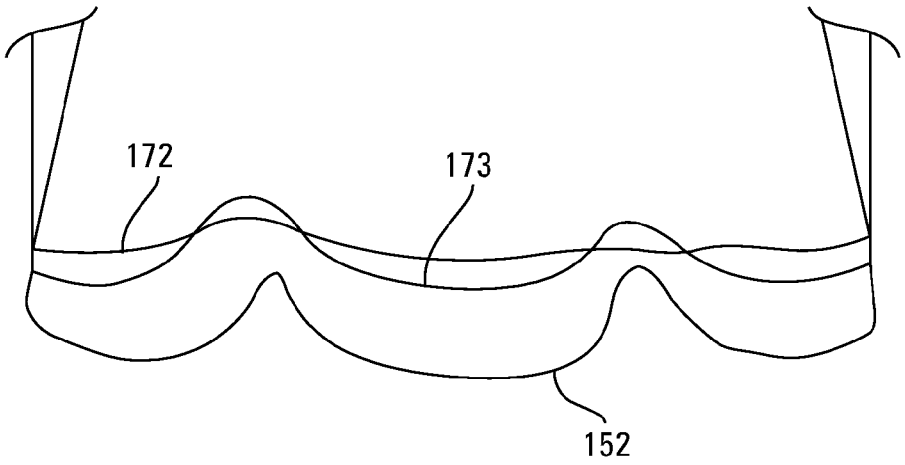
FIG. 16 is a vertical projection on the plane of the bottom surface showing the relative horizontal positions of irregular top edge 172, irregular bottom edge 173 and an outermost extending surface of the front face 104.
Figure 17:
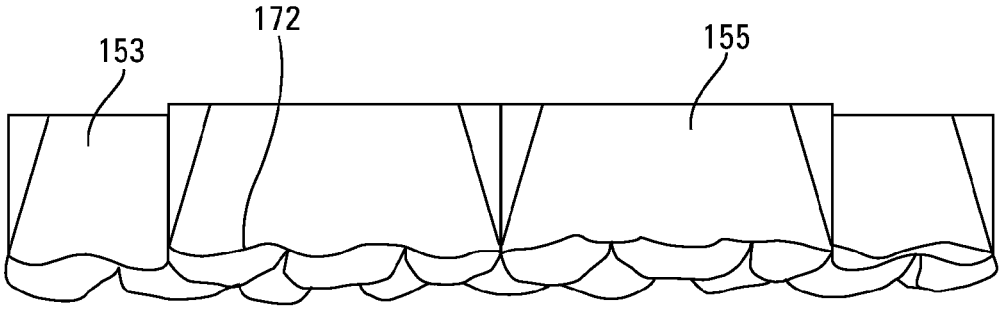
FIG. 17 is a top plan view of a partial wall constructed of blocks 100.

The irregular compound structure of front surface 104 is a useful feature of block 100 that enhances the three dimensionality of the front face to produce a more natural stone-like appearance and create a shadowing effect when viewed in a wall or other structure. Additionally, the upward sloping from edge 173 of front face 104 to apex point A (and hence the downward sloping from apex point A to bottom edge 173) create pronounced areas of undercutting when front face 104 is viewed in a wall or other structure. These undercut regions further enhance the three dimensionality of each respective shaped area and enhance the shadowing effect which can help hide the planar top surface of the lower adjacent course of blocks. (It should be noted that since top surface 102 of block 100 may be placed facing downward the same undercutting and shadowing effects would occur from the sloping of top edge 172 to apex point A.) FIGS. 16 and 17 illustrate these useful features of block 100.

FIG. 16 shows the relative horizontal positions of irregular top edge 172, irregular bottom edge 173 and an outermost extending surface of the shaped areas and other structures of front face 104. More specifically, FIG. 16 is a vertical projection of top edge 172 onto the plane of bottom surface 103 which contains bottom edge 173. Line 152 is the vertical projection of the outermost extending surface of the front face onto the plane. FIG. 16 shows that top edge 172 is positioned to the rear of bottom edge 173 in some locations and in front of bottom edge 173 in other locations. In some embodiments edge 172 is positioned to the rear of edge 173 along its entire length. In other embodiments edge 172 is positioned in front of edge 173 along its entire length. This particular configuration of the front face 104 has some very useful properties described further below in connection with FIG. 17

FIG. 17 is a top plan view of a partial wall constructed of blocks 100. The wall comprises a first lower course 153 of three blocks and a second upper course 155 of two blocks placed in a running bond configuration over the first course. The front face configuration described with respect to FIG. 16 is beneficial in the construction of a wall for several reasons. First, in some embodiments where the top edge 172 is set back from the vertical projection 152 of the front face by at least the set-back distance between courses of blocks in a wall constructed from blocks 100, then the top planar surface of the blocks in lower courses of the wall will not be visible in a top view of the wall. Thus, as shown in FIG. 17 the only visible parts of blocks in the first course which underlie blocks in the second course are portions of the front face. Top surface 102 of those blocks is not visible. Second, the positioning of top edge 172 relative to the bottom edge 173 of blocks of upper wall courses will create shadows or shade on blocks in adjacent lower courses which will hide or at least soften the transition between the courses. The shadows or shade also accentuate the projections or shaped areas adding to the three dimensional appearance of the wall.

Figure 18:
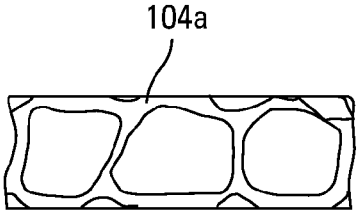
FIGS. 18 to 22 are front views of alternate embodiments of the front face and side edges of the block embodiment of FIGS. 1 to 8.
Figure 19:
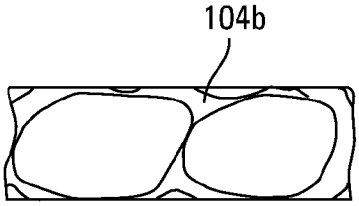
Figure 20:
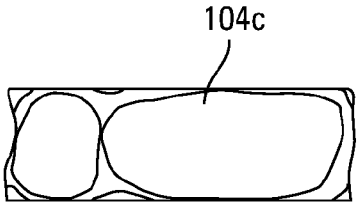

FIGS. 18 to 22 show alternate embodiments to front face 104 that are substantially similar to front face 104 except that the locations, shapes and dimensions of the shaped areas and valleys of front faces 104*a* to 104*e* have been given alternate locations, shapes and dimensions. However, the function of those features is the same as described above with respect to front face 104. FIG. 18 shows front face 104*a* with the shaped areas having different sizes and shapes and also shows differing slopes and widths of valleys separating the shaped areas. FIG. 19 shows front face 104*b* with two shaped areas and a single valley. FIG. 20 shows front face 104*c* with the two shaped areas having different sizes and shapes than the two shaped areas of FIG. 19. Additionally, the valley of FIG. 20 has different dimensions and a different slope than the valley of FIG. 19. FIGS. 21 and 22 show front faces 104*d* and 104*e*, respectively, with the side ends of the front face being substantially planar, such that the vertical edges separating the front face and side walls may be substantially vertically planar. Additionally, the shaped areas and valleys of FIGS. 21 and 22 have different dimensions, slopes and contours.

It should be understood that front face 104 (and front faces 104*a* to 104*e* and any other desired texture molded onto the front face) of block 100 could be molded onto any type of block and that the size, shape, and features of the block are not limiting. Thus, the front face, or any of the various embodiments of front faces of blocks shown herein, may be molded onto any type and size of block as desired. Additionally, the front face, and any of the various embodiments of front faces of blocks shown could be molded on blocks with or without cores, with or without pin holes, with or without receiving channels, with or without pin receiving cavities, or with other block features not discussed herein.

Figure 23:
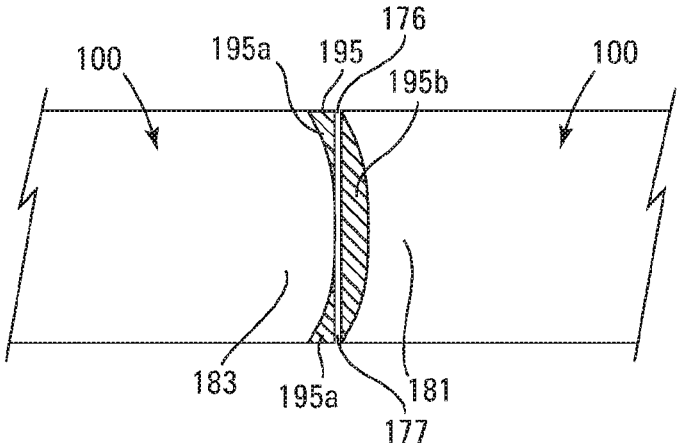
FIGS. 23, 24 and 25 are partial front views of adjacent blocks 100 in a course of blocks forming a wall showing alternate side configurations and false joint configurations.
Figure 24:
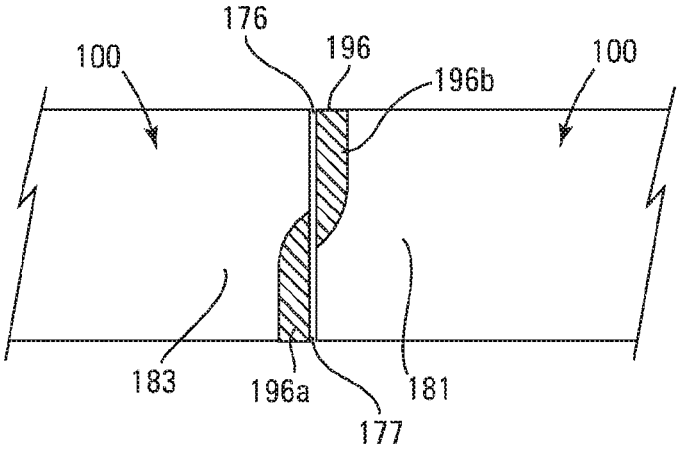
Figure 25:
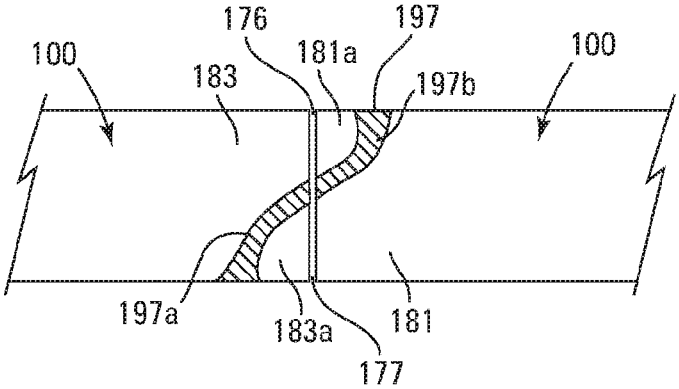

FIGS. 23, 24, and 25 are partial front views of adjacent blocks 100 in a course of blocks forming a wall and show variations in placement and configuration of false joints molded into front face 104 of block 100 having substantially vertical planar edges 176 and 177. In FIG. 23, a joint 195 is formed at the intersection of adjacent blocks 100 positioned in a course of a wall by joint portions 195*a* molded adjacent shaped area 183 of a first block and joint portion 195*b* molded adjacent shaped area 181 of a second block. In FIG. 24, a joint 196 is formed at the intersection of adjacent blocks 100 positioned in a course of a wall by joint portion 196*a* molded adjacent shaped area 183 of a first block and joint portion 196*b* molded adjacent shaped area 181 of a second block. In FIG. 25, a joint 197 extends from a first block 100 to a second block 100 and is defined by joint portion 197*a* molded into shaped area 183 of the first block such that joint portion 197*a* separates shaped area section 183*a* from the rest of shaped area 183. Joint portion 197*b* is molded into shaped area 181 of the second block such that joint portion 197*b* separates shaped area section 181*a* from the rest of shaped area 181. These joint configurations help hide or obscure the vertically oriented seams or spaces between blocks and provide the wall with a more unitary appearance. The features of joints 195, 196 and 197, all of which are positioned to crossover the intersection between two adjacent blocks in a wall, are similar to the features described previously in connection with other joints in the block face. For example, joints 195, 196 and 197 can be of any desired shape or configuration, can result in a deep undercut region, and may have a first portion formed from a projection in the stripper shoe and a second portion formed from a projection in the face liner.

Figure 26:
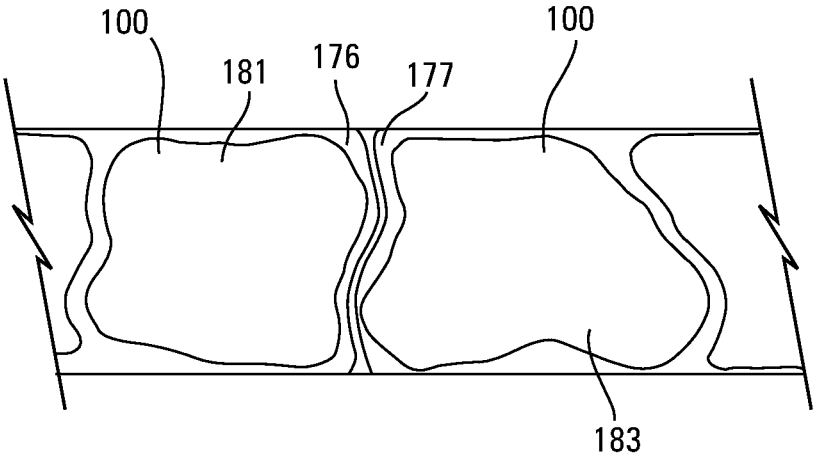
FIG. 26 is a partial front view of two blocks 100 positioned side-by-side as they would be placed in a course of a wall constructed with the blocks showing a connecting side configuration.

FIG. 26 is a partial front view of two blocks 100 positioned side-by-side as they would be placed in a course of a wall constructed with the blocks. First block 100 has edge 176 and second adjacent block 100 has edge 177, both edges 176 and 177 being non-planar and follow a meandering path from the top surface of the block to the bottom surface of the block which may, for example, be S-shaped and may be formed by moveable side liners and/or the forming stripper shoe. The meandering path followed by edge 176 is complementary to the path followed by edge 177 so that when the blocks are placed next to each other in a course they generally mate and present a non-vertical joint between the blocks which gives the wall a more natural appearance. Since the forming stripper shoe can impart a desired texture onto areas of side walls 106 and 107 in the mold cavity, the surface of shaped area 181 adjacent side wall 106 forms contoured side edge 176 along the front side end of the front face of a first block can mate or be paired with the contoured edge 177 of shaped area 183 adjacent side wall 107 of a second block when the blocks are placed adjacently in a course of blocks.

Figure 27:
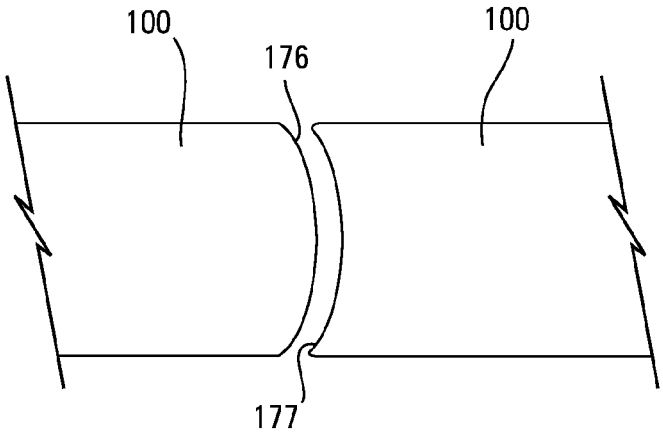
FIGS. 27, 28 and 29 are partial front views of adjacent blocks 100 in a course of blocks forming a wall showing alternate side configurations.
Figure 28:
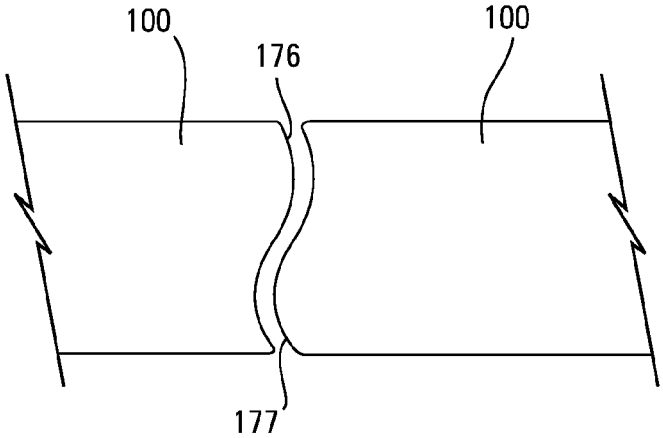
Figure 29:
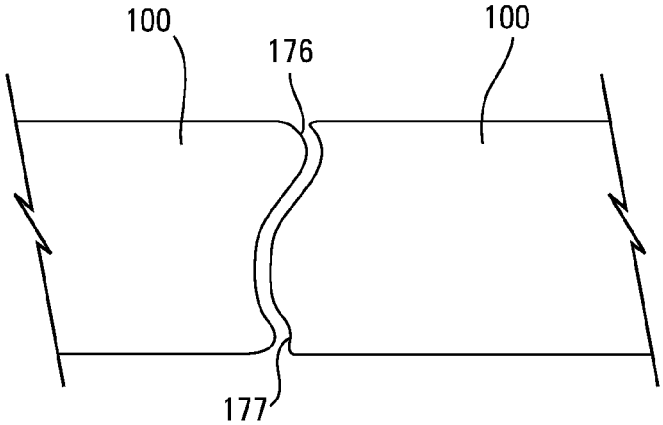

FIGS. 27, 28, and 29 are partial front views of adjacent blocks 100 in a course of blocks forming a wall. In these views block 100 has been provided with alternative configurations for edges 176 and 177. FIGS. 27 to 29 show further variations in placement and configuration of mating edges 176 and 177 molded into block 100 and illustrate how those different configurations provide walls constructed with the blocks a different visual appearance at the junction between adjacent blocks in the wall. Alternate configurations of mating edges and mating side walls can be seen in the block embodiments of FIGS. 30 to 38.

Figure 30:
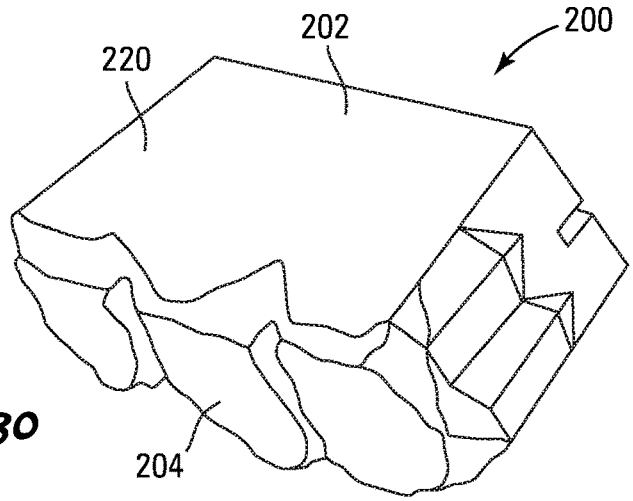
FIGS. 30, 31 and 32 are perspective, side and front views of alternate second block embodiment 200.
Figure 31:
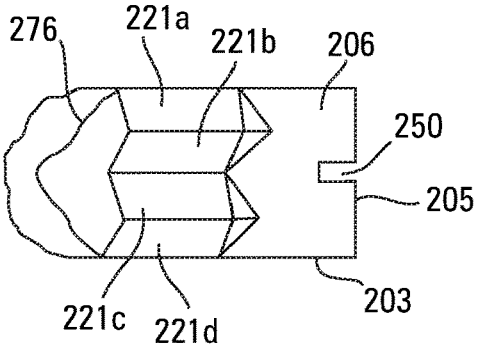
Figure 32:
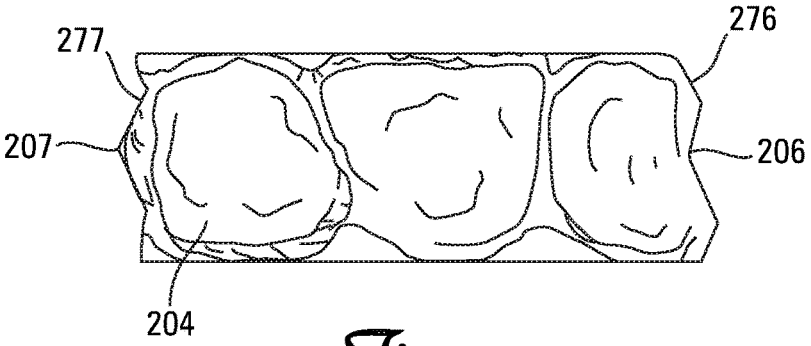

An embodiment of a wall block with mating edges and mating side walls is shown in FIGS. 30 to 32. Block 200 has a block body 220 having parallel top surface 202 and bottom surface 203, front face 204, rear face 205 and compound shaped first and second side wall surfaces 206 and 207. Rear surface has receiving channel 250 which extends from side wall 206 to side wall 207. Receiving channel 250 is designed to reduce the weight of the block and the amount of material used to manufacture the block. Receiving channel 250 could also be designed to accept a clipping or pinning system. It should be understood that the size, shape and dimensions of the receiving channel are not limiting and thus the block could have any size, shape or dimension as desired. Further, it should be understood that any of the blocks of the present invention may be manufactured with a receiving channel.

Side walls 206 and 207 each have multiple angular planar surfaces that extend from front face 204 towards rear face 205. As can be seen in FIGS. 30 and 31, side wall 206 has multiple angular planar surfaces 221*a*, 221*b*, 221*c* and 221*d* that extend from front face 204 toward rear face 205. Angular planar surfaces 221*a* extends outwardly away from top surface 202 at a downward slope. Angular planar surface 221*b* extends inwardly towards side wall 206 from angular planar surface 221*a* at a downward slope. Angular planar surface 221*c* extends outwardly away from angular planar surface 221*b* at a downward slope and angular planar surface 221*d* extends inwardly towards bottom surface 203 from angular planar surface 221*c* at a downward slope. Angular planar surfaces 221*a*, 221*b*, 221*c* and 221*d* may extend any or all of the length of side wall 206 or may converge toward rear face 205 as desired. Angular planar surfaces 221*a*, 221*b*, 221*c* and 221*d* create an even more exaggerated or pronounced irregularly contoured ends or edges 276 and 277 which are the junctions of side wall 206 and front face 204 and side wall 207 and front face 204, respectively. Edges 276 and 277 may follow the irregular contour of the angular planar surfaces 221*a*, 221*b*, 221*c* and 221*d* of side wall 206 and the irregular contour of the angular planar surfaces of side wall 207 as seen best in FIG. 32. The angular planar surfaces of side wall 207 have a negative or opposite contour of the angular planar surfaces of side wall 206 and as such the contour of side wall 207 will align and abut the contour of side wall 206 when the blocks are positioned adjacent one another in a course of blocks.

It should be understood that block 200 is not limiting and that block 200 could have any desired shape and could be any desired dimension. It should be further understood that front face 204 could have any shape, pattern or texture as desired.

Figure 33:
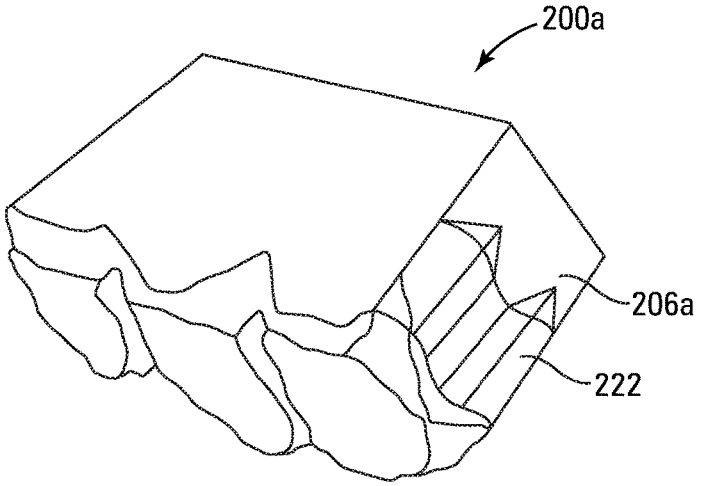
FIGS. 33, 34 and 35 are perspective, side and front views of an alternate embodiment of block 200.
Figure 34:
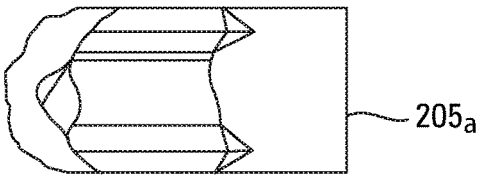
Figure 35:
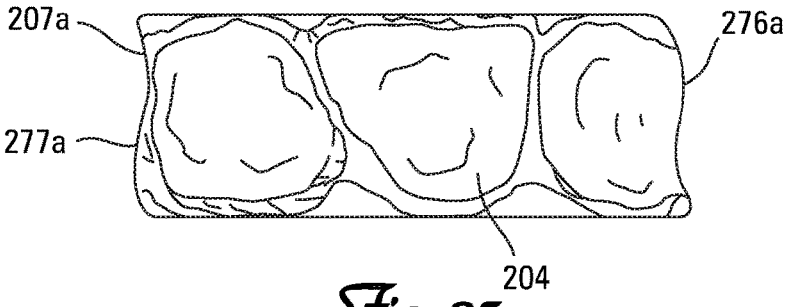
Figure 36:
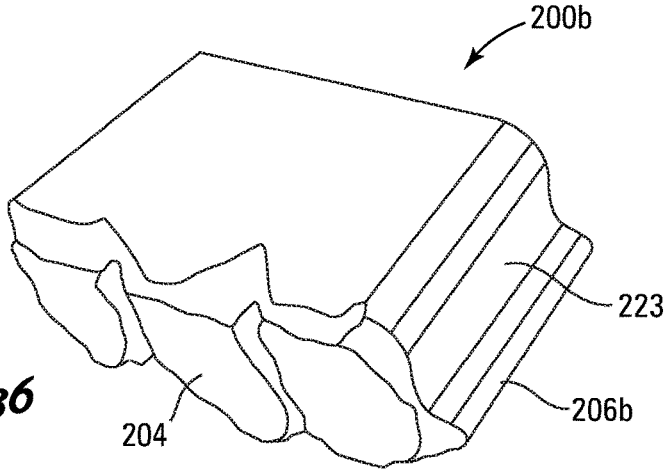
FIGS. 36, 37 and 38 are perspective, side and front views of an alternate embodiment of block 200.
Figure 37:
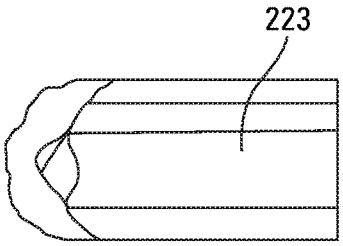
Figure 38:
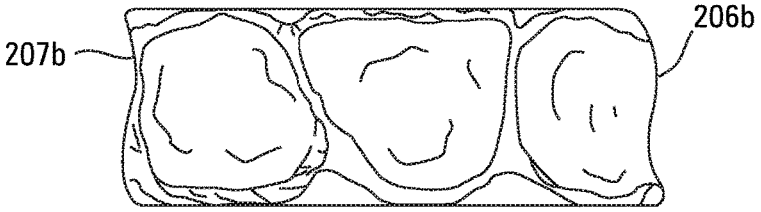

Alternate configurations of block 200 are shown in FIGS. 33 to 35 and 36 to 38. Features of these configurations which are the same or substantially the same as in block 200 are identified by the same reference numerals used to describe block 200. Features which are different from block 200 are described below and are identified with different reference numerals. FIGS. 33 to 35 show a block 200*a* which has a structure similar to block 200 except that side walls 206*a* and 207*a* have multiple contoured surfaces 222 that extend from front face 204 towards rear face 205*a*. The multiple contoured surfaces 222 give side walls 206*a* and 207*a* a contoured S-shape. The multiple contoured surfaces 222 surfaces create S-shaped contoured ends or edges 276*a* and 277*a* which are the junctions of side wall 206*a* and front face 204 and side wall 207*a* and front face 204, respectively. Surface 222 of side wall 207*a* has a negative or opposite contour of the surface 222 of side wall 206*a* and as such the contour of side wall 207*a* will align and abut the contour of side wall 206*a*. Additionally the S-shaped contours of side walls 206*a* and 207*a* allow adjacent blocks to be flipped relative to one another such that the contour of the side walls of a top surface up block will align and abut the contour of the side walls of an adjacent bottom surface up block. FIGS. 36 to 38 show a block 200*b* which has a structure similar to block 200*a* except that side walls 206*b* and 207*b* have multiple contoured surfaces 223 that extend from front face 204 to rear face 205 giving the entirety of side walls 206*b* and 207*b* a contoured S-shape.

An embodiment of the wall block is shown in FIGS. 39 to 41. Block 300 is made of a rugged, weather resistant material; preferably (and typically) zero-slump molded concrete. Block 300 has parallel top surface 302 and bottom surface 303, front face 304, rear face 305 and compound first and second side wall surfaces 306 and 307.

Side walls 306 and 307 each have vertical planar surface 322 that extend from front face 304 to rear face 305, the vertical planar surface 322 of side wall 306 being parallel to the vertical planar surface 322 of side wall 307. Vertical planar surfaces 322 of side walls 306 and 307 are generally orthogonal to rear face 305 and may also be orthogonal to front face 304. Vertical planar surfaces 322 are also orthogonal to bottom surface 303 and top surface 302. Side wall 306 has an angular groove 324. Angular groove 324 has angular planar surface 321 that converges from front face 304 toward rear face 305. Angular planar surface 321 is non-orthogonal to side surface 306 and rear face 305 and is orthogonal to horizontal planar surface 323 of angular groove 324. Angular planar surface 321 may angle from the vertical plane of the rear face toward the front face at any desired angular degree and thus could be in the range of 1° to 25° and could be 20°. Side wall 307 has an angular projection 325. Angular projection 325 has angular planar surface 326 that converges from rear face 305 toward front face 304 and is parallel to angular planar surface 321 of side wall 306 and thus can be angled at the same angular degree as angular planar surface 321. Angular planar surface 326 is non-orthogonal to side surface 307 and may be orthogonal to horizontal planar surface 327 of projection 325. Angled projection 325 could angle away from the vertical plane of the rear face 305 towards side wall 307 and/or front face 304 at any desired angle and could be in the range of 1° to 25° and could be 20°. Horizontal planar surfaces 327 may each have a groove 328 adjacent to vertical planar surface 322 of side wall 307.

Angular projection 325 of a first block 300 is shaped and sized to be received in an angular groove 324 of a second adjacent block 300 when placed in a course of blocks in a wall or other desired structure. It should be understood that angular groove 324 and angular projection 325 are not limiting could be given any shape or size as desired such as the shapes and sizes of angular projections shown in FIGS. 42 to 44. As shown in FIG. 39, angular projection 325 of side wall 307 gives block 300 a substantially trapezoidal shape such that the width of block 300, from side wall 306 to side wall 307, towards rear face 305 is greater than the width of block 300, from side wall 306 to side wall 307, towards front face 305.

Top surface 302, bottom surface 303, front face 304, rear face 305 and vertical planar surfaces 321 of side walls 306 and 307 form block body 320. Angular projection 325 may be cut, knocked off or in some other way generally removed from block body 320 during construction of a wall or other structure when necessary or desired. Grooves 328 aids in removing angular projection from block body 320 and also helps provide for cleaner and more controlled break. Additionally and/or alternatively the portion of block body above and/or below angular groove 324 from side wall 306 to the dashed line seen in FIG. 39 may also be knocked away from block 300. Removing the portions of the block above and below angular groove 324 and/or removing angular projection 325 from the block allows block 300 to have versatility when constructing a desired structure and can be used in the construction of convex shaped portions of walls or other structures.

It should be understood that block 300 is not limiting and that block 300 could have any desired shape and could be any desired dimension. It should be further understood that front face 304 could have any shape, pattern or texture as desired and could be substantially flat or planar.

Figure 42:
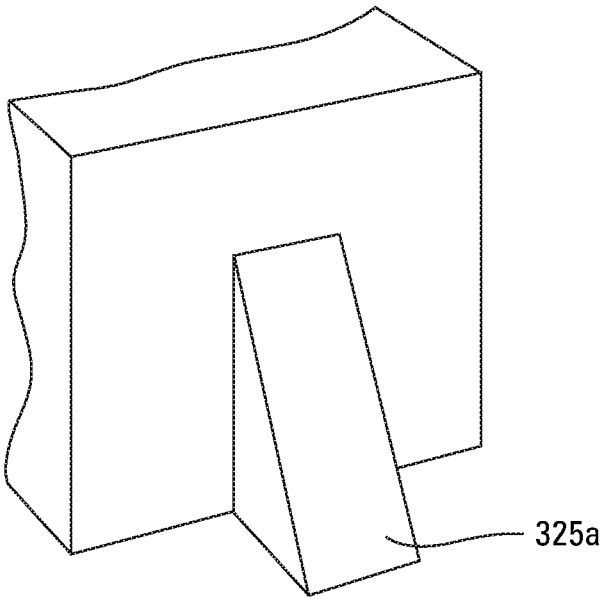
FIGS. 42, 43 and 44 are side perspective views of alternate projection embodiments of the blocks of the present invention.
Figure 43:
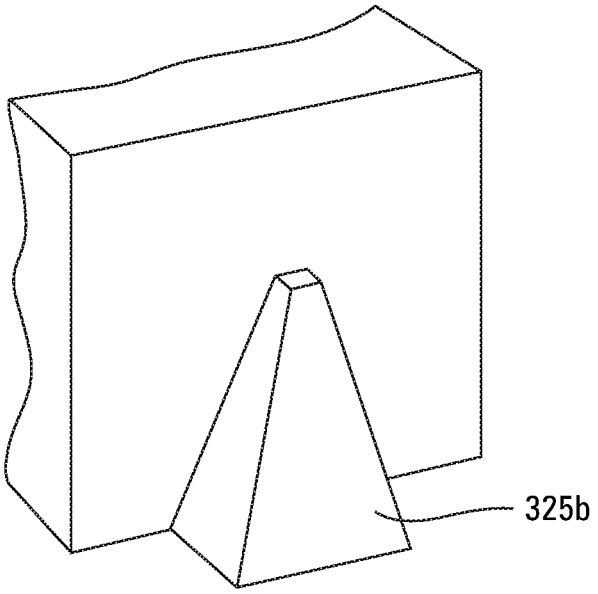
Figure 44:
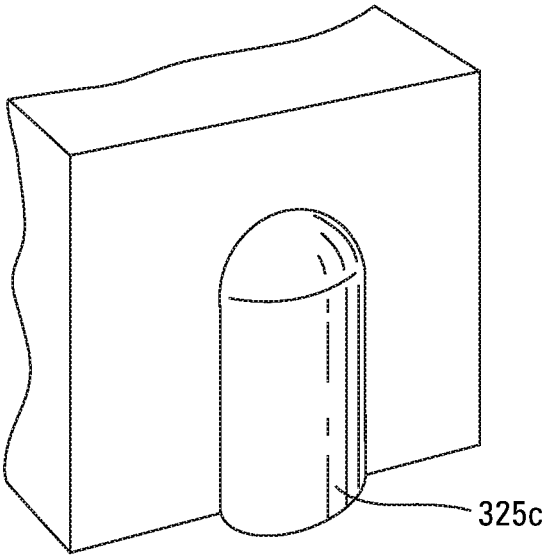

FIGS. 42 to 44 show angular projections 325*a*, 325*b*, and 325*c*, respectively. Projection 325*b* of FIG. 43 could also be configured to come to a point where the projection meets the side wall of the block.

Figure 45:
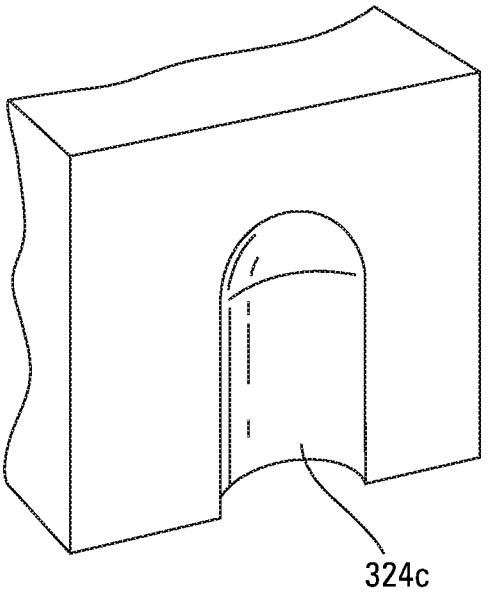
FIG. 45 is a side perspective view of an alternate groove embodiment of the blocks of the present invention.

The block of FIGS. 44 and 45 have half hemisphere shaped projection 325*c* that can be received in half hemisphere shaped groove 324*c* of an adjacent block. It should be understood that a version of the half hemisphere shaped projection 325*c* and groove 324*c* could be formed on any block embodiment disclosed herein as desired. An edger block to border a garden, patio or other landscaped surface with the front surface of the block facing upward and the rear surface of the block facing downward can be configured from the embodiment of the block of FIGS. 44 and 45 whereby the half hemisphere projection and groove extend from the visually exposed top (front) surface to the downward facing rear surface. Alternatively, if the curved projection and curved groove were shaped as shown in FIG. 27, this would allow the edger block to follow irregular contoured and/or curved surfaces as the projection 325*c* pivots or rotates within groove 324*c*.

Figure 46:
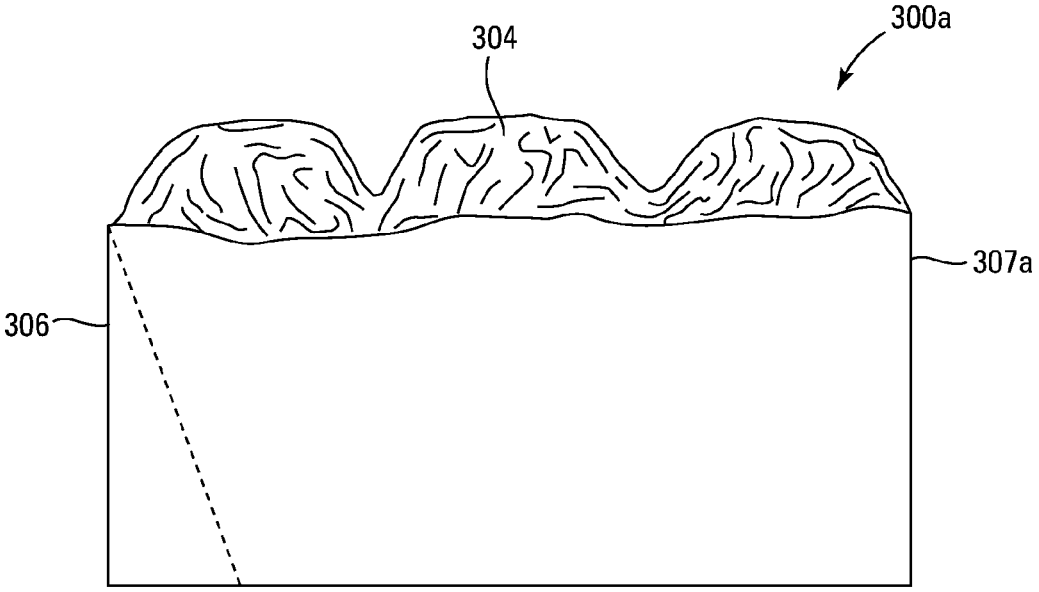
FIGS. 46 and 47 are top and rear views of an alternate embodiment of block 300.
Figure 47:
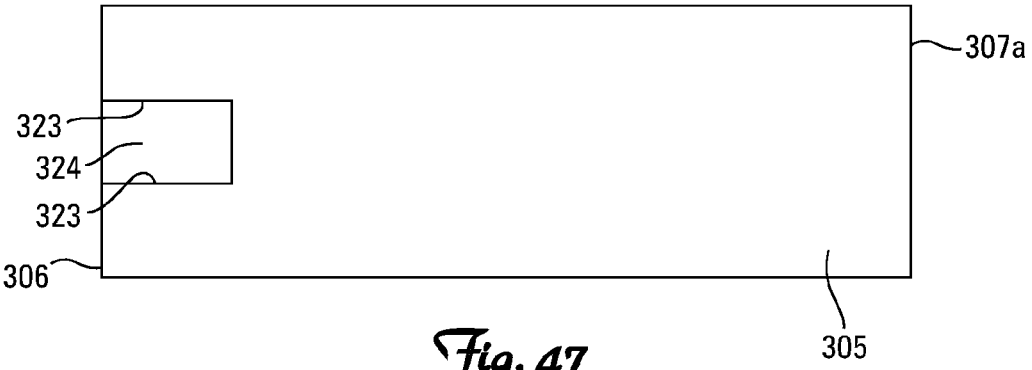

FIGS. 46 and 47 shows an alternate embodiment of block 300. Block 300*a* has a structure similar to block 300 except that angular projection 325 is eliminated. Instead, side wall surface 307*a* extends substantially vertically between the top and bottom surfaces of block 300*a* and intersects the rear face at an orthogonal angle. It should be understood that an alternate configuration of block 300 could have the block molded to have side wall surface 307 extending substantially vertically between the top and bottom surfaces of block 300 and intersecting the rear face at an angle which is not orthogonal to the rear face. Side wall surface 307*a* of block 300*a* may be molded with a similar texture or pattern as the front face of block 300 by a side liner that imparts the texture or pattern onto side surface 307*a*. The texture or pattern that is molded onto the front face and side surface 307*a* gives a texture or pattern on two surfaces of the block and, as such, allows block 300*a* to be used as a corner block in the construction of a wall or structure having a corner with two visual or exposed surfaces.

An embodiment of the wall block is shown in FIGS. 48 and 49. Block 400 has parallel top surface 402 and bottom surface 403, front face 404, rear face 405 and parallel first and second side wall surfaces 406 and 407. Bottom surface 403 has a first angular groove 431 that extends from side wall 406 to rear face 405 and a second angular groove 431 that extends from side wall 407 to rear face 405. Angular grooves 431 each extend a desired height into the block from the bottom surface toward the top surface. Grooves 431 may be molded into bottom surface 403 of the block by side or end liners or by other means as desired. Grooves 431 aid in removing block portions 441 from the remaining block body by providing a weakened break-away channel that allows for a cleaner and more controlled break. Removing one or both block portions 441 at angular groove 431 from the remaining block body allows block 400 to have versatility when constructing a desired structure and can be used in the construction of convex shaped portions of walls or other structures. Additionally, the top surface of the block can be positioned facing upward on the most upper course of the wall constructed with the blocks to create a capping or finishing layer since the top surface constitutes a continuous planar surface without any grooves.

It should be further understood that front face 404 could have any shape, pattern or texture as desired and could be substantially flat or planar. It should further be understood that grooves 431 could be positioned on the block at any desired location including the top surface of the block and that grooves 431 could have any shape, size or dimension as desired.

Figure 50:
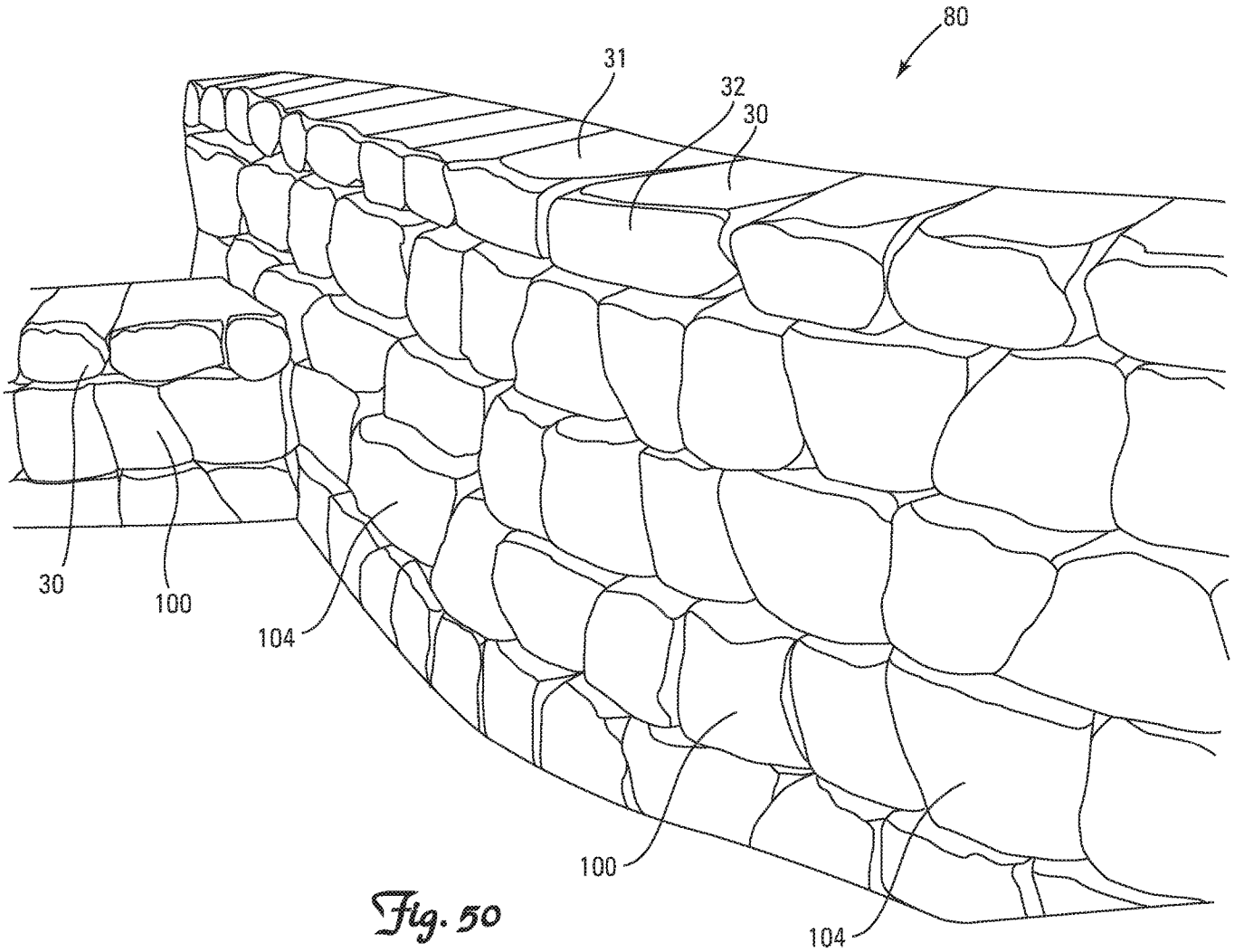
FIGS. 50 and 51 are perspective views of a wall constructed with the blocks of FIGS. 1 to 8.
Figure 51:
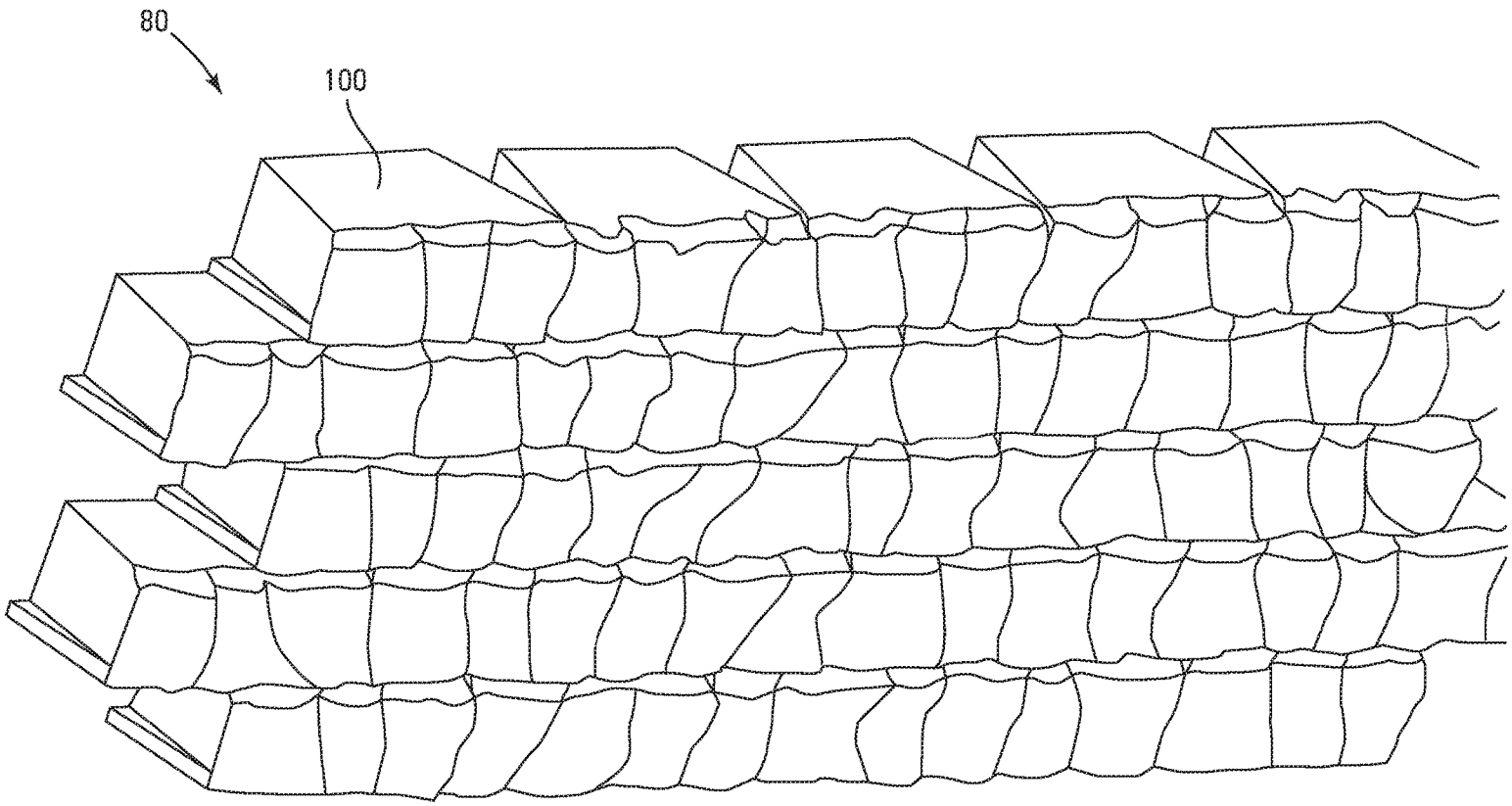
Figure 52:
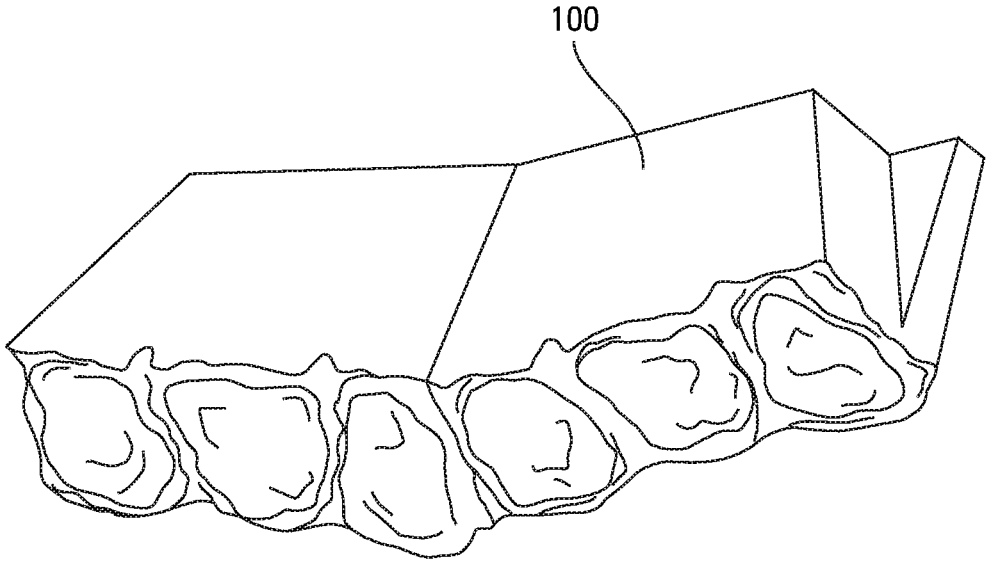
FIG. 52 is a partial front view of two blocks 100 positioned side-by-side as they would be placed in a course of a convex wall constructed with the blocks of FIGS. 1 to 8 showing the side configuration with wing portions removed.
Figure 53:
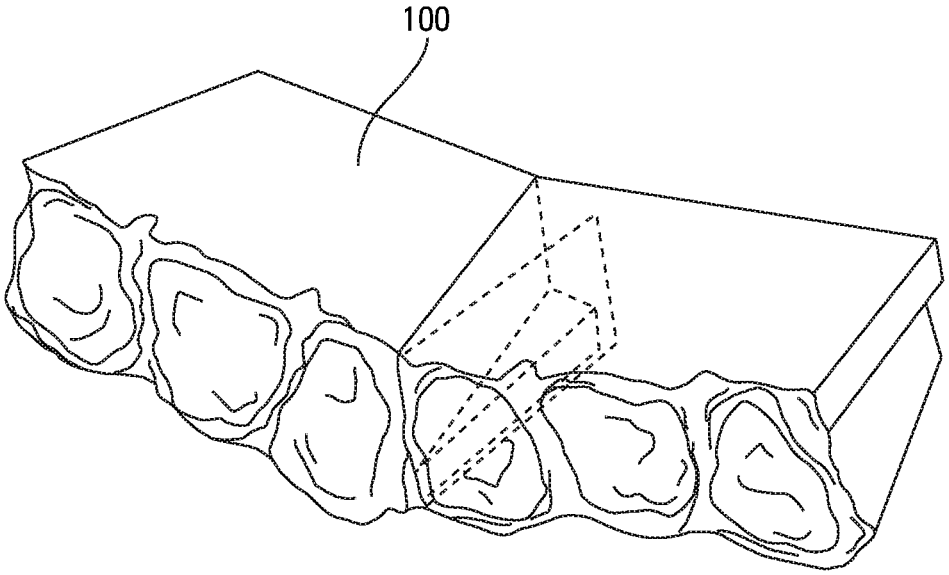
FIG. 53 is a partial front view of two blocks 100 positioned side-by-side as they would be placed in a course of a convex wall constructed with the blocks of FIGS. 1 to 8 showing the side configuration with a first block having the bottom surface facing downward and the bottom surface of the second adjacent block facing upward.
Figure 54:
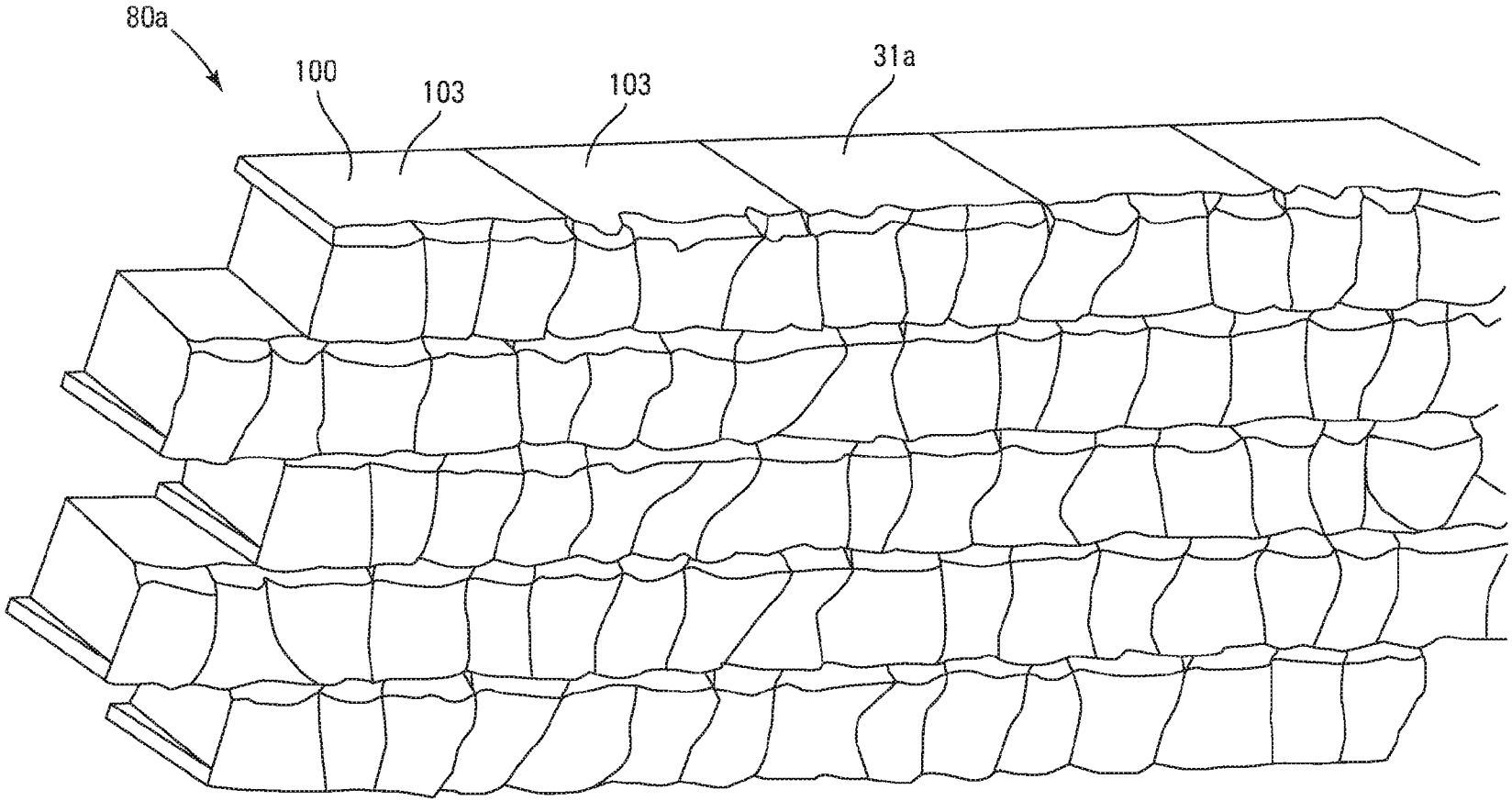
FIG. 54 is a perspective view of a wall constructed with the wall blocks of FIGS. 1 to 8 having the capping or uppermost layer with the bottom surface of block 100 facing upward such that the bottom surface of block 100 of the capping or uppermost layer forms a continuous surface having no gaps between the blocks.
Figure 55:
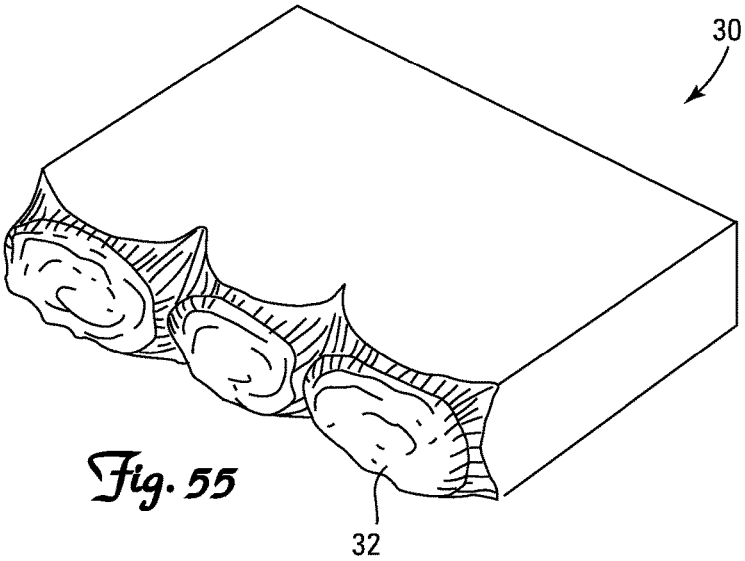
FIGS. 55 to 58 are perspective, front, side and top views of an alternate block embodiment comprising a separate capping block of the present invention.
Figure 56:
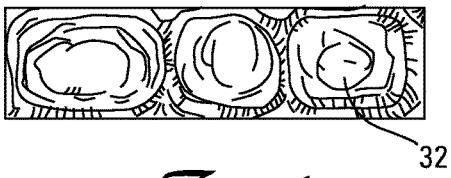
Figure 57:
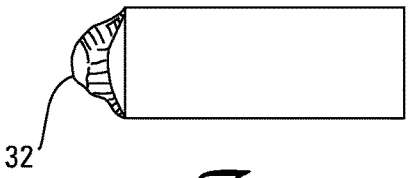

FIGS. 50 and 51 illustrate views of a fully constructed wall and partially constructed wall 80, respectively, made from block 100. Wall 80 has been constructed with block 100 with multiple different embodiments of front face 104. Block 100 is used to form a wall having a front surface. Generally, when constructing a wall, a trench is excavated to a pre-selected depth and partially filled with a level base of granular material such as crushed stone. A base layer of blocks are then placed and leveled onto the crushed stone. The blocks are placed side to side with front face 104 facing outward and the bottom surface 103 facing downward. It should be understood that wall 80 may be constructed with top surface 102 facing downward and/or a combination of downward facing bottom surfaces and top surfaces. To build a wall with convex curves, one or both wings 116 and 117 may be removed from the block body. When wing 116 and/or 117 is removed, the removed wing surface of the block body has substantially the same angular planar contour as angular planar surface 121 of the side of the block the wing was removed. Thus, the angular planar surface 121 and removed wing surface of a first block abuts the angular planar surface 121 and removed wing surface of a second block and is shown in FIG. 52. Additionally and/or alternatively, a first block may be placed with the bottom surface facing downward and an adjacent block placed with the bottom surface 103 facing upward such that the vertical planar surface of the second block abuts against the angular planar surface 121 of the first block, allowing the wall to be built with or without a curve and is shown in FIG. 53 (the abutting side walls are shown in phantom lines). Walls built in this manner also allow for a more random appearance to the front surface of the wall. By alternating the bottom surface for the top surface of adjacent blocks, the design of the front face of the block is flipped, creating further front face design embodiments. Once the base layer is laid, the second layer is laid with the bottom surface 103 of the blocks of the second layer placed upon the top surface 102 of the blocks of the base layer. It should be noted that when the block is used in constructing a gravity wall, the weight of the blocks may be sufficient for stability without the use of a pinning system or other adhesion system. When the desired height of the wall is achieved the last or upper course of blocks may comprise blocks 100 laid with the bottom surface 103 facing upwards so that block 100 forms its own capping block. FIG. 54 shows a wall 80*a* constructed with block 100 where the capping layer or uppermost layer has been laid with bottom surface 103 facing upward to create a continuous capping or finishing layer 31*a*. By retaining or removing one or both of side wings 116 and 117, depending on whether the wall is straight or curved, a continuous smooth upper wall surface can be achieved without the need to use a separate capping block.

Alternatively, a capping block 30 such as shown in FIGS. 55 to 58 may be used to form a capping or finishing layer 31 as shown in FIG. 50 for walls made with block 100 and for walls made with the other block embodiments disclosed herein. Capping block 30 may be formed in a mold the same way as block 100 with or without angular planar surfaces of side walls 106 and 107. Capping block 30 may have a front face 32 similar to front face 104 of block 100. Front face 32 may have shaped areas and valleys. The shaped areas may have undercut regions along the bottom surface of the capping block so that the finishing layer of the wall has a visual appearance which is compatible with the rest of the exposed wall surface.

Figure 59:
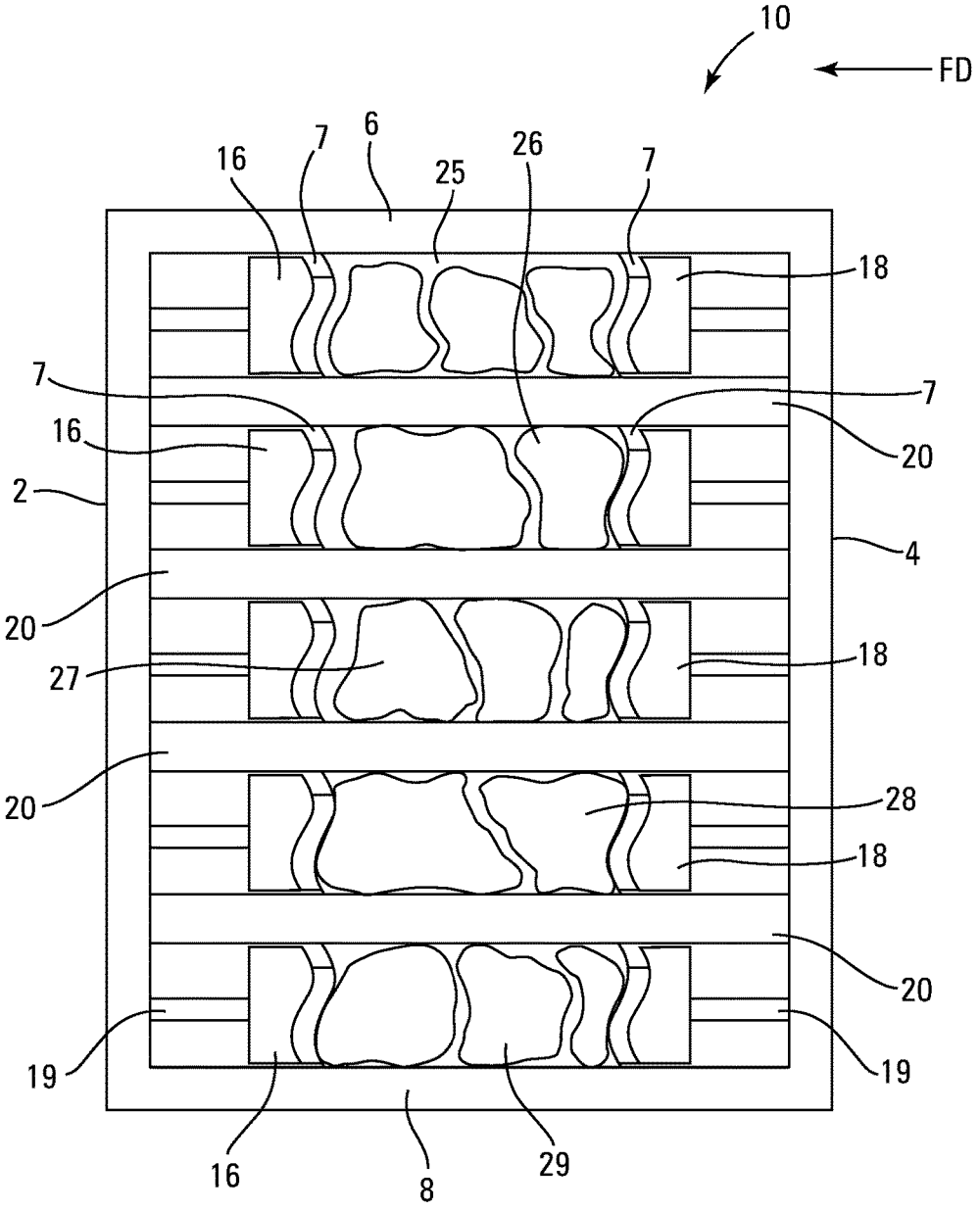
FIG. 59 is a top view of a mold box for molding blocks of the present invention.
Figure 60:
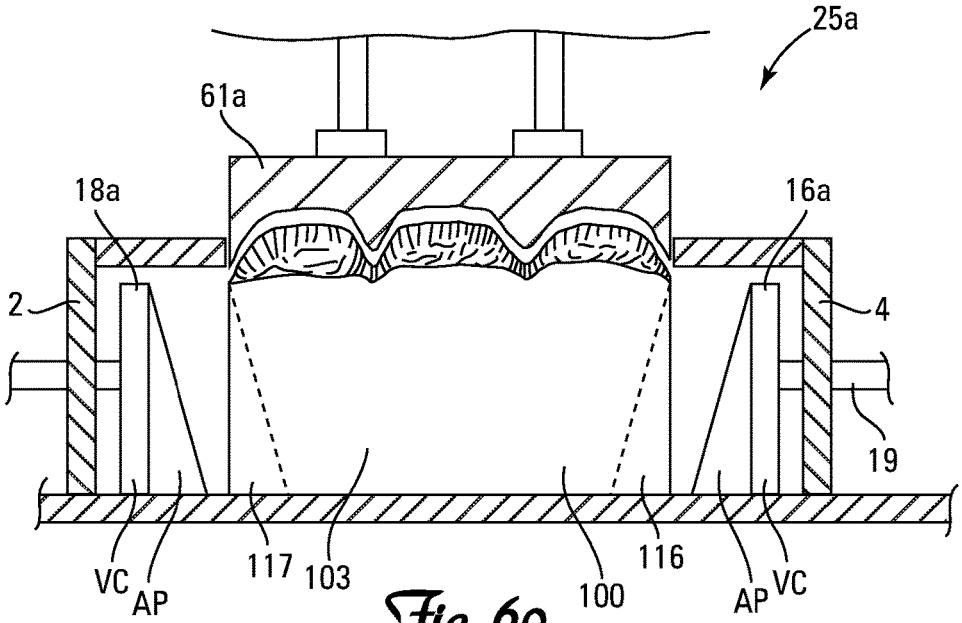
FIGS. 60 and 61 are rear and front cross-sectional views, respectively of a mold cavity for making the blocks of FIGS. 1 to 8.
Figure 61:
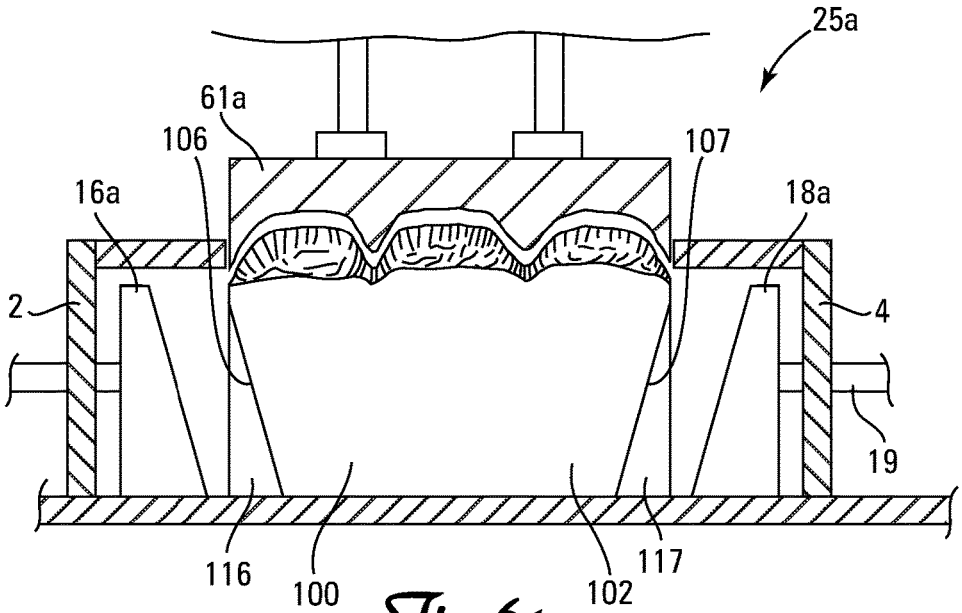
Figure 62:
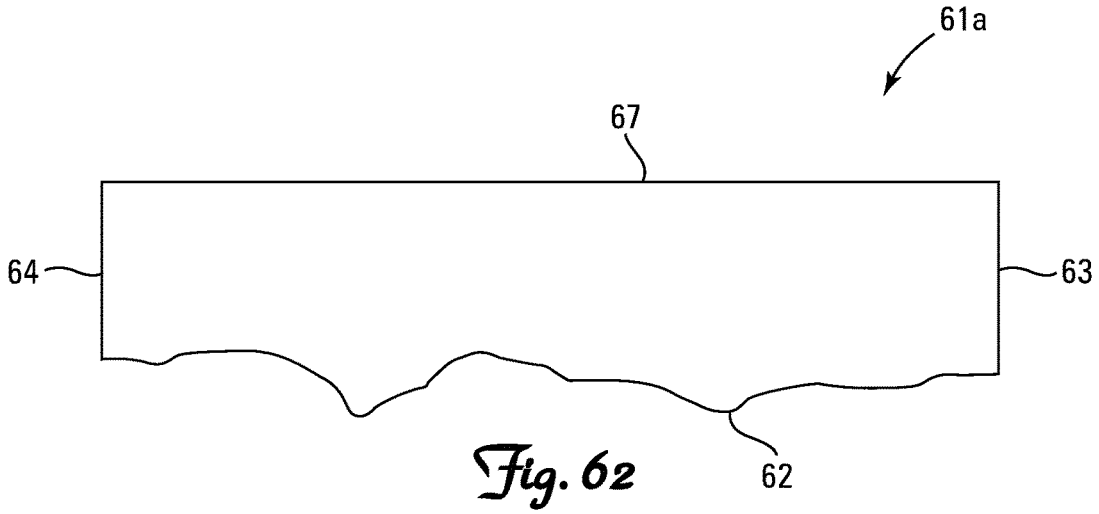
FIGS. 62 to 65 are front, side, cross-sectional front and cross-sectional side views of a forming stripper shoe of the present invention.
Figure 63:
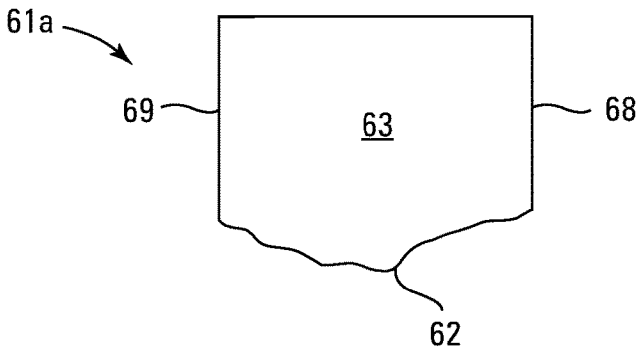

FIG. 59 is a top plan view of a multi-block mold box 10 for making the blocks described herein. The particular configuration shown in FIGS. 60 and 61 is used to make blocks 100. By modifying the particular features of the mold box to incorporate molding surfaces and moveable liners as will be discussed hereafter, mold box 10 can be configured to make any of the block embodiments disclosed herein. Mold box 10 generally includes opposing first and second side frame walls 2 and 4 and opposing first and second end frame walls 6 and 8. Moveable side liners 16 and 18 form sidewalls of the wall blocks of the present invention and can have a contoured molding surface having a compound shape that may be formed, or machine cut during the manufacture of the mold box. Side liners 16 and 18 may be shaped such that a portion of side liners 16 and 18 does not extend all the way into the mold cavity leaving a wing shaped gap 7 for the formation of recessed wings 116 and 117 of side walls 106 and 107. Alternatively, the contoured molding surface of the moveable face liners can be formed by the use of replaceable liners as known in the art. Moveable means 19 allows the moveable liners to move from an engaged position when the mold is ready to be filled with material to a disengaged position when the material is being stripped from the mold box and then back to the engaged position. When in the engaged position, the moveable face liners are aligned with the side walls and/or center frame walls of the mold cavity, enclosing the molding area to be filled and forming the mold cavity. After the mold cavity has been filled with material, the moveable face liner moves to the disengaged position where the moveable face liner retracts or moves away in some motion from the enclosed mold cavity, allowing the mold to be stripped away from the moveable liner and mold cavity without damaging the molded material. Mold box 10 may have various dimensions, typical dimensions of this mold box are about 26 inches (660 mm) wide (i.e., the width of both the first and second end walls), 18 inches (460 mm) long (i.e., the length of both the first and second side walls), and 8 inches (200 mm) thick.

Division frame walls or division liners 20 span side frame walls 2 and 4 of mold box 10 may be formed, machined or flame cut during the manufacture of the mold box to form a single, continuous and seamless mold joint. Alternatively, the ends of division frame wall 20 may be securely or removably fixed to side walls 2 and 4 in a conventional manner. Division frame wall 20, first and second end walls 6 and 8 and moveable side liners 16 and 18 form mold cavities 25, 26, 27, 28 and 29. Additionally and/or alternatively division liners could be used in place of division frame walls 20 to separate the mold cavities as is known in the art. Mold cavities 25, 26, 27, 28 and 29 may form blocks or block shapes with identical lengths, heights and widths. It should be understood that blocks formed in mold cavities 25, 26, 27, 28 and 29 may have differing or substantially similar block features such as the front face, side walls and front face edges. It should further be understood that the mold cavities could form blocks with differing block dimensions and/or shapes.

Figure 58:
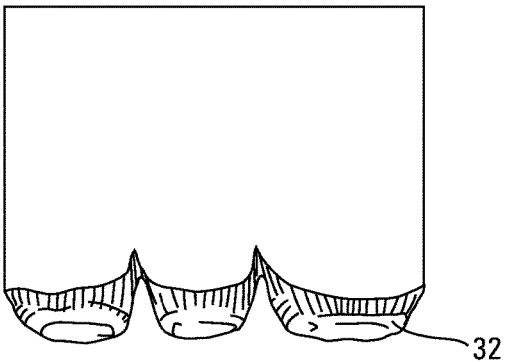

The blocks are oriented in the mold box such that the front faces of the blocks are generally oriented facing upward with the top and bottom surfaces of the block being parallel to end frame walls 6 and 8 and parallel to the direction of travel of the feed drawer and cut-off bar represented in FIG. 58 by arrow FD. The feed drawer and cut-off bar are well known to those of skill in the art and are not shown in the drawing figures.

FIGS. 60 and 61 shows cross-sectional back and front views, respectively, of a mold box cavity 25*a* which has moveable side liners 16*a*, and 18*a* for making block 100. The cross-sectional view is along a vertical plane intersecting midpoints of side liners 16*a* and 18*a*. Side liner 16*a* forms sidewall 106 and side liner 18*a* forms sidewall 107. The angular projection AP of both side liners 16*a* and 18*a* create the angular planar surfaces 121 of both sidewalls 106 and 107 while the vertical column VC and angular projection AP of side liners 16*a* and 18*a* form side wings 116 and 117. FIG. 60 shows the bottom surface 103 of the molded block 100 and illustrates the formation of the angular planar surfaces 121 of the side walls shown in phantom dashed lines relative to the formed wings 116 and 117 while FIG. 61 illustrates this concept shown from the top surface 102 of molded block 100.

Forming stripper shoe 61*a* forms front face 104 and, as forming stripper shoe 61*a* aligns with moveable side liners 16*a* and 18*a*, also forms edges 176 and 177. Each mold cavity 25, 26, 27, 28 and 29 have forming stripper shoes 61 that form front face 104 and each forming stripper shoe 61 may be substantially similar or may be different but all forming stripper shoes may have similar features. As such, the following description of features of forming stripper shoe 61*a* applies to similar features of other forming stripper shoes 61 even though locations, dimensions and quantities may differ from one forming stripper shoe to the next.

FIGS. 62 to 65 are front, side, cross-sectional front and cross-sectional side views, respectively, of a forming stripper shoe 61*a*. Forming stripper shoe 61*a* has upper surface 67, bottom edge 62, front and rear surfaces 68 and 69 and side surfaces 63 and 64. Additionally, forming stripper shoe 61*a* has molding surface 65 that contacts and compresses the masonry material in the mold box and forms front face 104 of block 100. Bottom edge 62 of the front, back and sides of forming stripper shoe 61 molds the top, bottom and side edges, respectively, of the block formed in the mold cavity.

Figure 64:
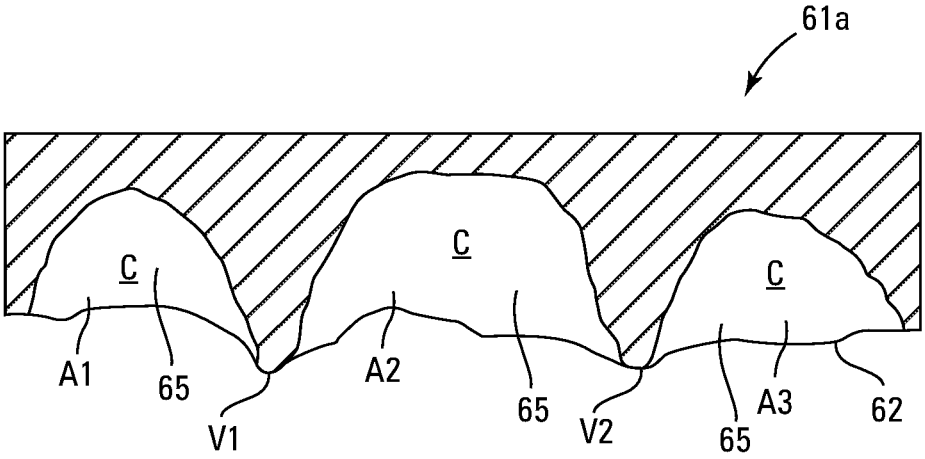
Figure 65:
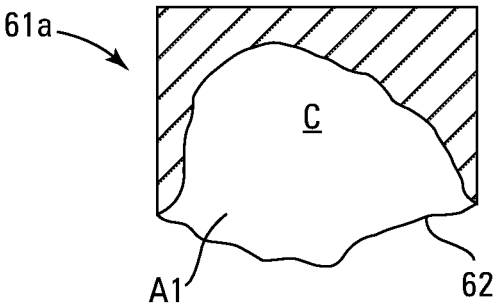

As best seen in FIGS. 64 and 65 which are cross-sectional front and side views, respectively, of the stripper shoe, molding surface 65 has protruding joint or valley forming surfaces V1 and V2 as well as shaped area forming surfaces A1, A2, and A3. Shaped area forming surfaces A1, A2 and A3 may have any desired degrees of sloping, if any, from the innermost extending point of each respective shaped area forming surface of molding surface 65 to bottom the bottom edges of molding surface 65 of forming stripper shoe 61*a* that allows forming stripper shoe 61*a* to be stripped from the mold upon completion of the molding process. As such, degrees of downward slope may be in the range of 0° to 90° from vertical. The sloping of molding surface 65 also functions to mold a visually pleasing aesthetic appearance onto front face 104 of block 100 so that when blocks 100 are stacked in a wall with the top surface facing upward, the upper course of block creates a shadowing effect over the front face 104 of the lower course of block enhancing the three dimensional effect of the shaped areas of the front faces of the blocks in the wall. The sloping of molding surface 65 also is configured to have sloping surfaces that will create a draft angle such that the molded front face 104 will be able to be stripped from the forming stripper shoe 65. Valley forming surfaces mold the valleys or joints of front face 104 and can extend into the mold cavity at any desired dimension and may have any desired slope.

As best seen in FIG. 64, forming stripper shoe 61*a* forms an upwardly extending cavity C in locations where the shaped areas are formed. Cavity C is properly filled with block forming material as the forming stripper shoe is provided with a downwardly extending force toward the mold cavity. It should be understood that the dimensions, quantities and locations of the features of forming stripper shoe 61*a* are not limiting and that forming stripper shoes of the present invention could have features described above of varying dimensions, quantities and locations.

Figure 66:
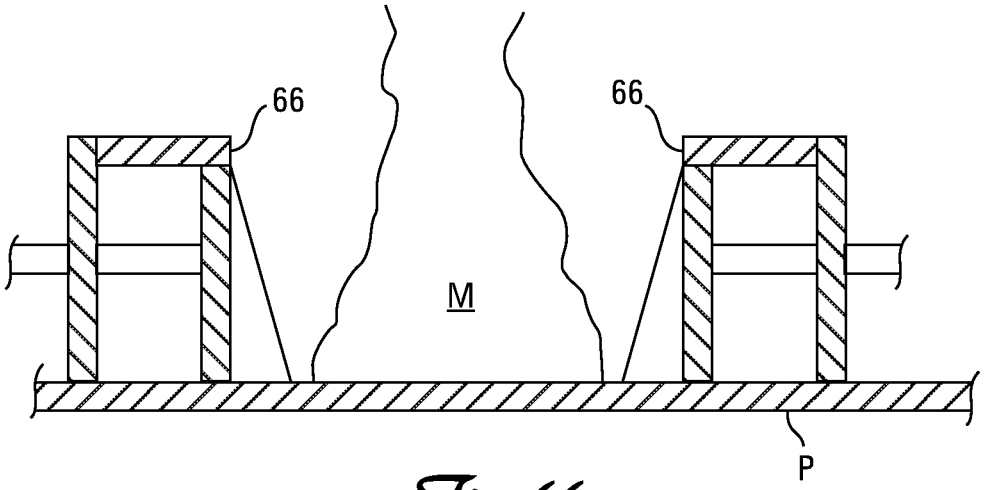
FIGS. 66, 67 and 69 are rear cross-sectional views
Figure 67:
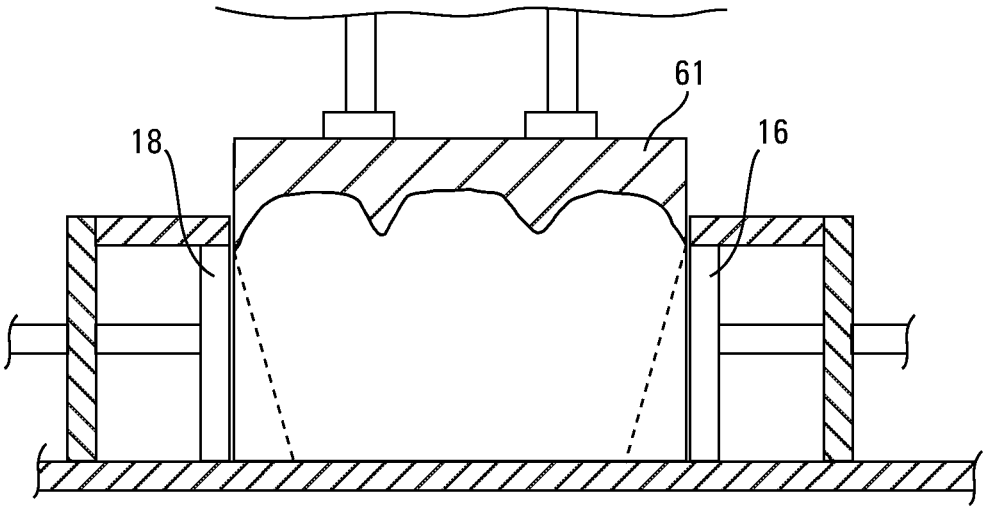
Figure 68:
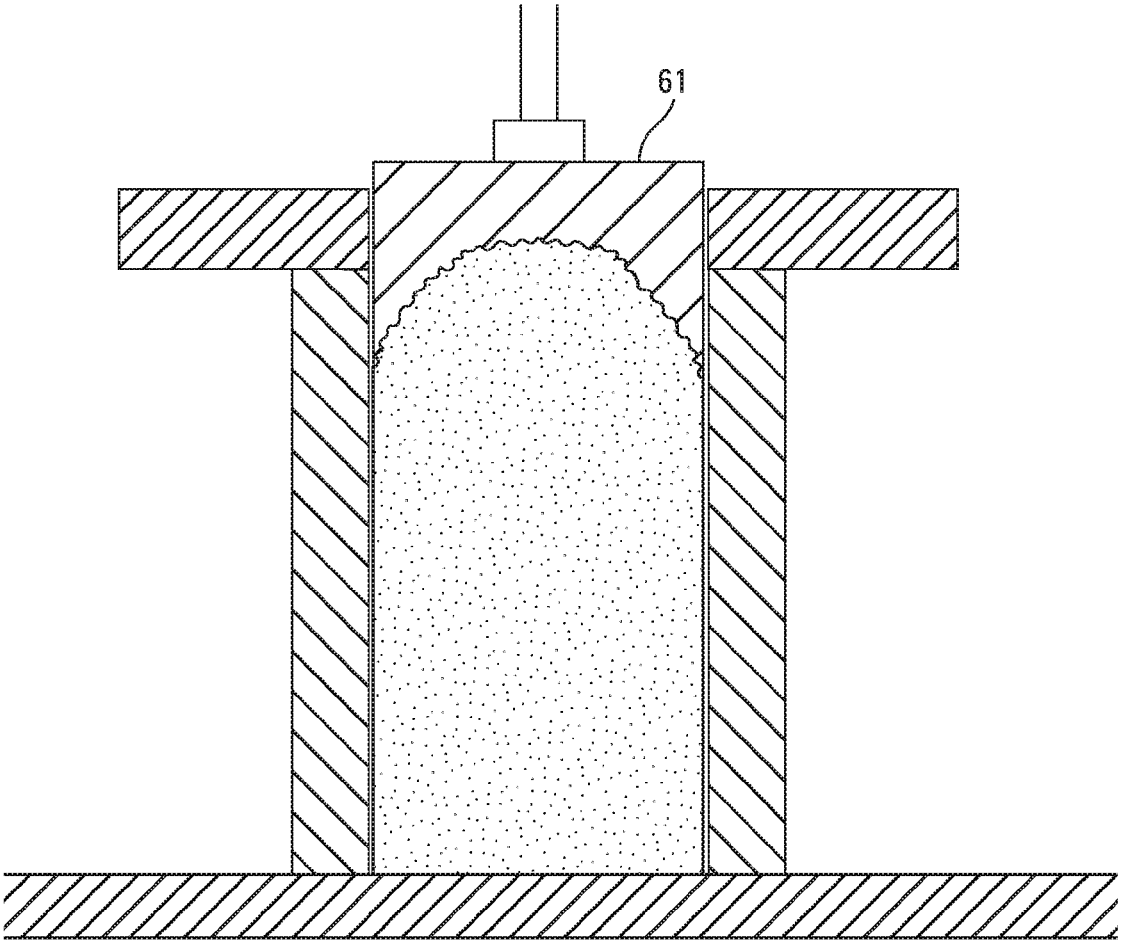
FIG. 68 is a cross-sectional side view of a mold cavity shown during different stages of the molding process.
Figure 69:
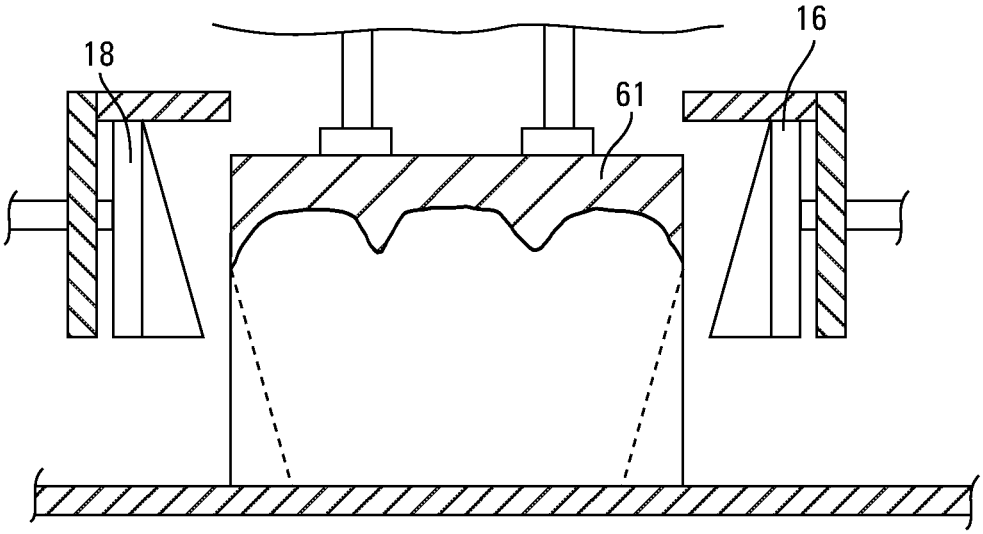

During a block making process mold box 10 is configured to rest upon a pallet P to form mold cavities 25, 26, 27, 28 and 29 as seen in FIG. 59. Moveable means 19 moves side liners 16 and 18 between discharge and engaged positions. FIG. 68 is a cross-sectional side view and FIGS. 66, 67 and 69 are cross-sectional back views of a mold cavity shown during different stages of the molding process. Other mold cavities configured to form each of the block embodiments disclosed herein function in a similar manner. FIG. 66 shows masonry material M being deposited into the mold cavities by a feed drawer (not shown) as it passes over the mold box. Excess material is removed by a cut-off bar as the feed drawer moves away from the mold box so that the masonry material is level with the top of the mold box and the top surfaces of the forming members. As the material settles into the mold cavities, a vibratory action may be employed to aid in the compaction of material in each mold cavity. Overfill surfaces 66 are non-forming surfaces that align with or abut with sides 63 and 64 of forming stripper shoe 61 and are located above moveable side liners 16 and 18. Since overfill surfaces 66 are located below the cut-off bar travel path and above the molding surface of the side liners, the overfill surfaces, therefore, allow for the deposit of extra material at the top of the mold cavity. This helps to ensure that a cavity C formed within the molding surface 65 of the forming stripper shoe 61 receives a sufficient amount of material to fill the cavity after the material is compacted by the stripper shoe.

Next, forming stripper shoe 61 from a head assembly contacts the masonry material from above thereby forming the material in the mold cavity as seen in FIGS. 67 and 68. Molding surface 65 of forming stripper shoe 61 compresses the material deposited adjacent overfill surface 66, forming front face 104 of block 100. The extra material deposited adjacent overfill surface 66 is dispersed and compressed into and around the molding surface 65 of forming stripper shoe 61 to ensure sufficient material is available to completely and adequately fill cavity C and mold the material into all molding surfaces. As the material is being compacted and compressed into the contoured surfaces of molding surface 65, the slope of valley forming surface V1 aids in material distribution into the contours of molding surface 65 by the force of the compaction caused by the forming stripper shoe 61 pushing material against the angled or sloped surface of the valley forming surface V1 or other inwardly extending surfaces. The forming stripper shoe may be allowed to overtravel by any designed amount and for example could over travel 1/16 of an inch or more depending upon the application. Further, the head assembly may be fitted with an overtravel stop that will not allow the head assembly to lower past a certain depth inside the mold. As the movable side liner retracts from the engaged position to the disengaged position, forming stripper shoe 61 then push the molded material through the mold cavity and strip the molded material from the mold while being held in a stationary position in accordance with procedures well known to those of skill in the art as seen in FIG. 69.

In this embodiment the molding surface of the forming stripper shoe molds the material deposited adjacent an overfill surface, forming front face 104 of block 100 as the mold box ascends. The extra material deposited adjacent overfill surface is dispersed and compressed into and around the molding surface of forming stripper shoe to ensure sufficient material is available to completely and adequately fill and mold the material into all molding surfaces.

Although the block making process has been described with respect to block 100 it should be understood that the process is similar for other block embodiments described herein. Differences may include the configuration and molding surfaces of the liners and stripper shoes and that one or even all of the liners may be moveable from an engaged to a disengaged or discharge position.

Figure 70:
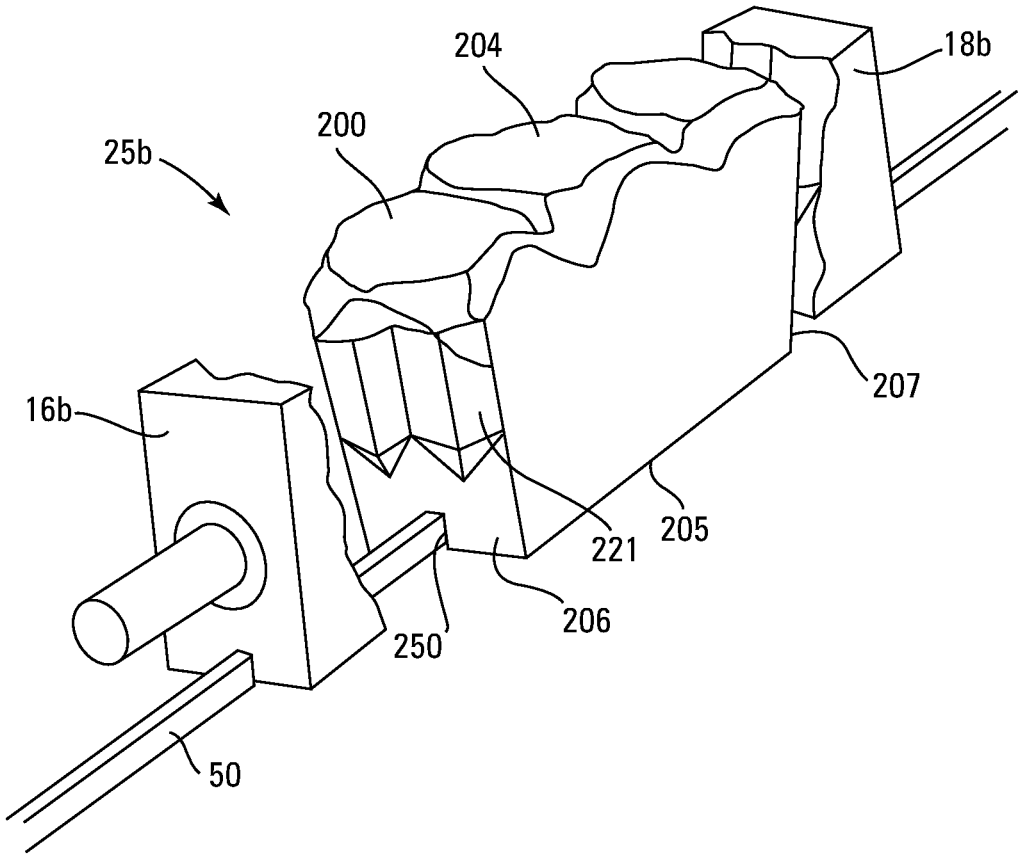
FIG. 70 is an exploded perspective view of moveable side liners, channel forming member for making blocks 200.

FIG. 70 shows an exploded perspective view of moveable side liners and a channel forming member for which define a part of a mold cavity 25*b* that molds block 200 of the present invention. It should be understood that mold cavity 25*b* represents one mold cavity which might be included in a mold such as mold box 10 shown in FIG. 59. Moveable side liner 16*b* forms sidewall 206 and angular planar surfaces 221 of side wall 206 and moveable side liner 18*b* forms sidewall 207 and angular planar surfaces of side wall 207. A channel forming member 50, made with a moveable core element that is pulled in coordination with the moveable side liners, forms optional receiving channel 250 on rear surface 205 of block 200 and the forming stripper shoe forms front face 204. It should be understood that this mold cavity is not limiting and that the mold cavity could be manufactured to not include the channel forming member. Additionally, it is to be understood that any mold cavity disclosed herein could be configured to include the channel forming member and, as such, a block disclosed herein could be molded with a receiving channel.

Figure 71:
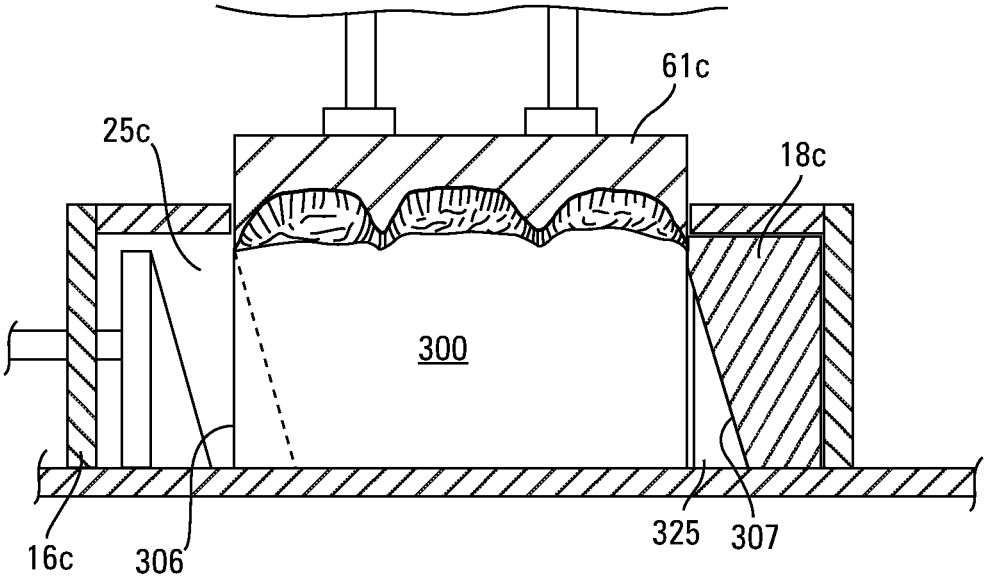
FIG. 71 is a front cross-sectional side view of a mold cavity for making blocks 300.

FIG. 71 is a cross-sectional view of a mold cavity which can be used to make blocks having elements of the unique surface features and configurations described herein. FIG. 71 shows mold box cavity 25*c* which has moveable side liners 16*c*, and stationary side liner 18*c* for making block 300. Moveable side liner 16*c* includes a molding surface shaped to form sidewall 306 and angular groove 324 and stationary side liner 18*c* includes a molding surface shaped to form sidewall 307 and angular projection 325. Forming stripper shoe 61*c* forms front face 304.

Figure 72:
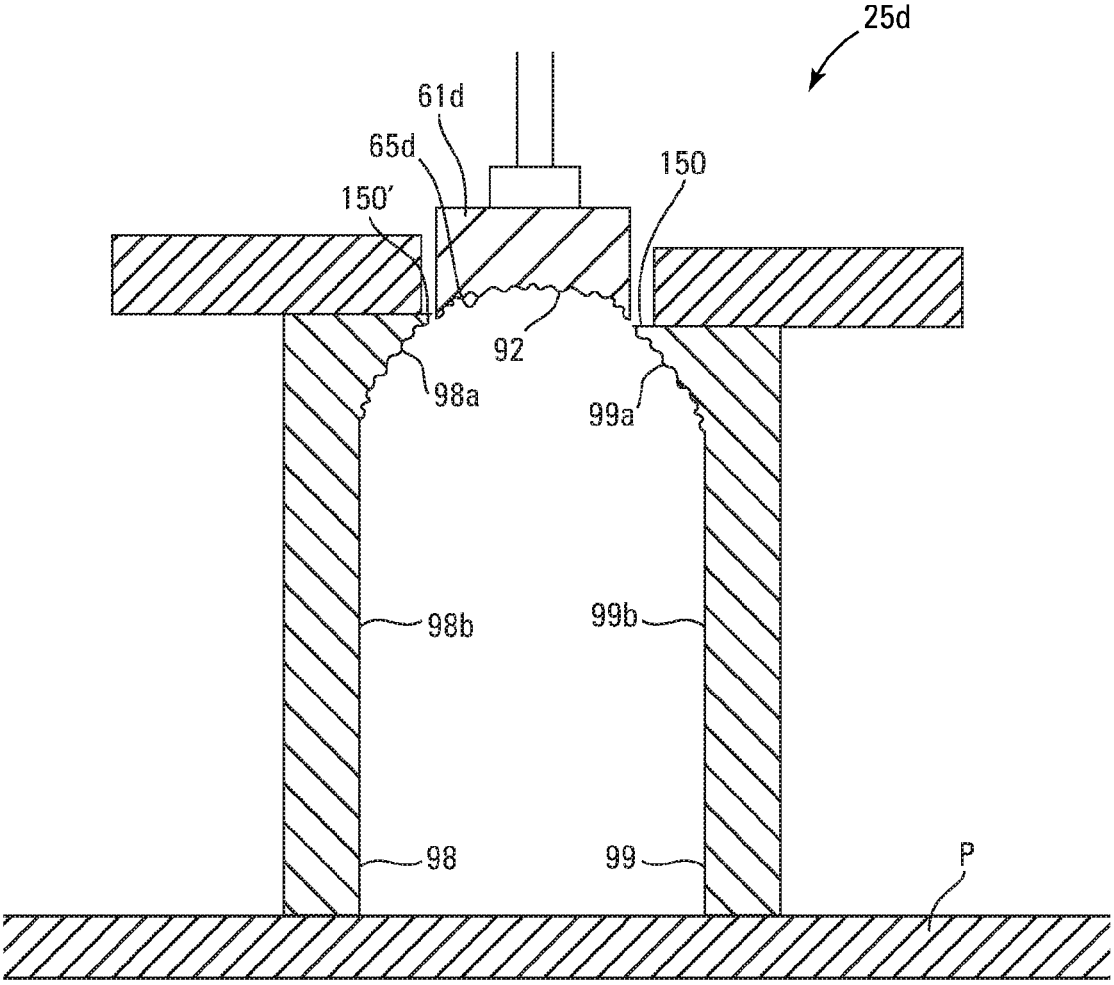
FIG. 72 is a cross-sectional side view of a mold assembly and mold cavity.

FIG. 72 shows mold having a mold cavity 25*d* which includes optional features for forming the front face of a block in accordance with the present invention. A stripper shoe 61*d* has a textured portion 65*d* for forming a first portion 92 of a front face of a block. The mold includes stationary side liners 98 and 99 having planar molding surfaces 98*b* and 99*b* to form substantially planar top and bottom surfaces of the block and textured or patterned molding surfaces 98*a* and 99*a* to form a second textured or patterned portion of the front face of the block. Moveable or stationary face liners, either textured or smooth, (not shown) can be used to form the sides of the various block embodiments disclosed herein as described above. Molding surfaces 98 and 99 may also create parting lines 150 and 150' where they meet molding surface 65*d* of the stripper shoe, depending on the shape, angle and configuration of the molding surfaces of the stationary side liners and the stripper shoe. Additionally, since molding surfaces 98 and 99 form the second portion of the block along both the top and bottom edges of the block, both the top and bottom of the block can be provided with relatively steep undercuts.

Figure 73:
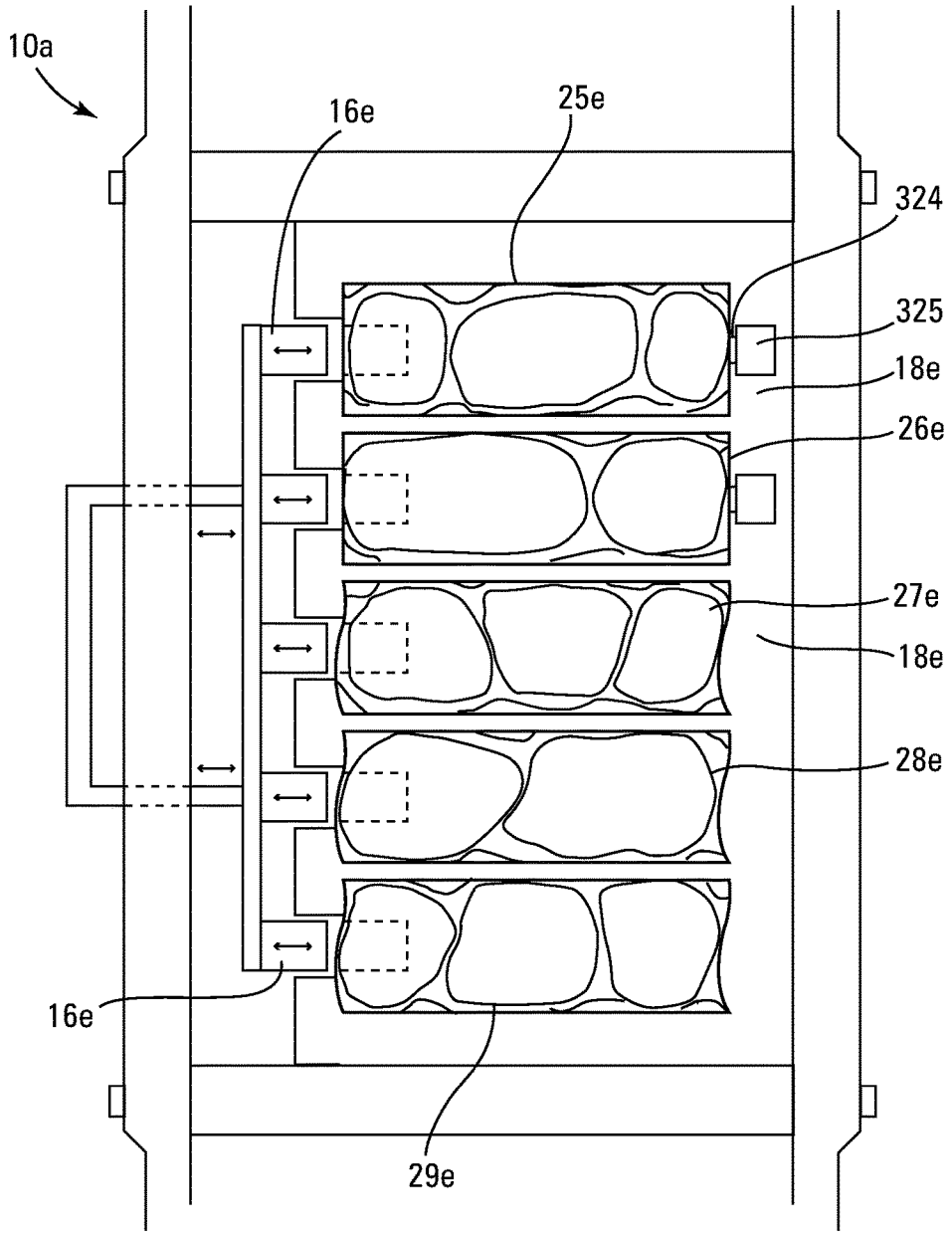
FIG. 73 shows a mold box for making the blocks of the present invention.

FIG. 73 is a top plan view of a multi-block mold box 10*a* for making the blocks described herein. Specifically, the mold has been adapted to make blocks 300 and or a variation thereof. During a block making process mold box 10*a* is configured to rest upon a pallet to form mold cavities 25*e*, 26*e*, 27*e*, 28*e* and 29*e*. Moveable means 19 moves side liners 16*e* which forms an angular groove in the mold of mold cavities 25*e*, 26*e*, 27*e*, 28*e* and 29*e*. Moveable side liners 16*e* are shown in this embodiment as being connected to one another and being controlled by the same mechanism. Stationary side liners 18*e* are shown as being separate from one another for each mold box and are further shown to mold different features onto the blocks. Stationary side liner 18*e* in mold cavity 25*e* and 26*e* are shaped to form angular projection 325 and groove 324 of block 300. Stationary liners 18*e* of mold cavities 27*e*, 28*e* and 29*e* are shaped to form a modified version of block 300 which does not include angular projection 325 (block 300*a*). Rather, stationary liners 18*e* of cavities 27*e*, 28*e* and 29*e* are shaped, along with the forming stripper shoe, to form contoured side edges onto the block.

Figure 74:
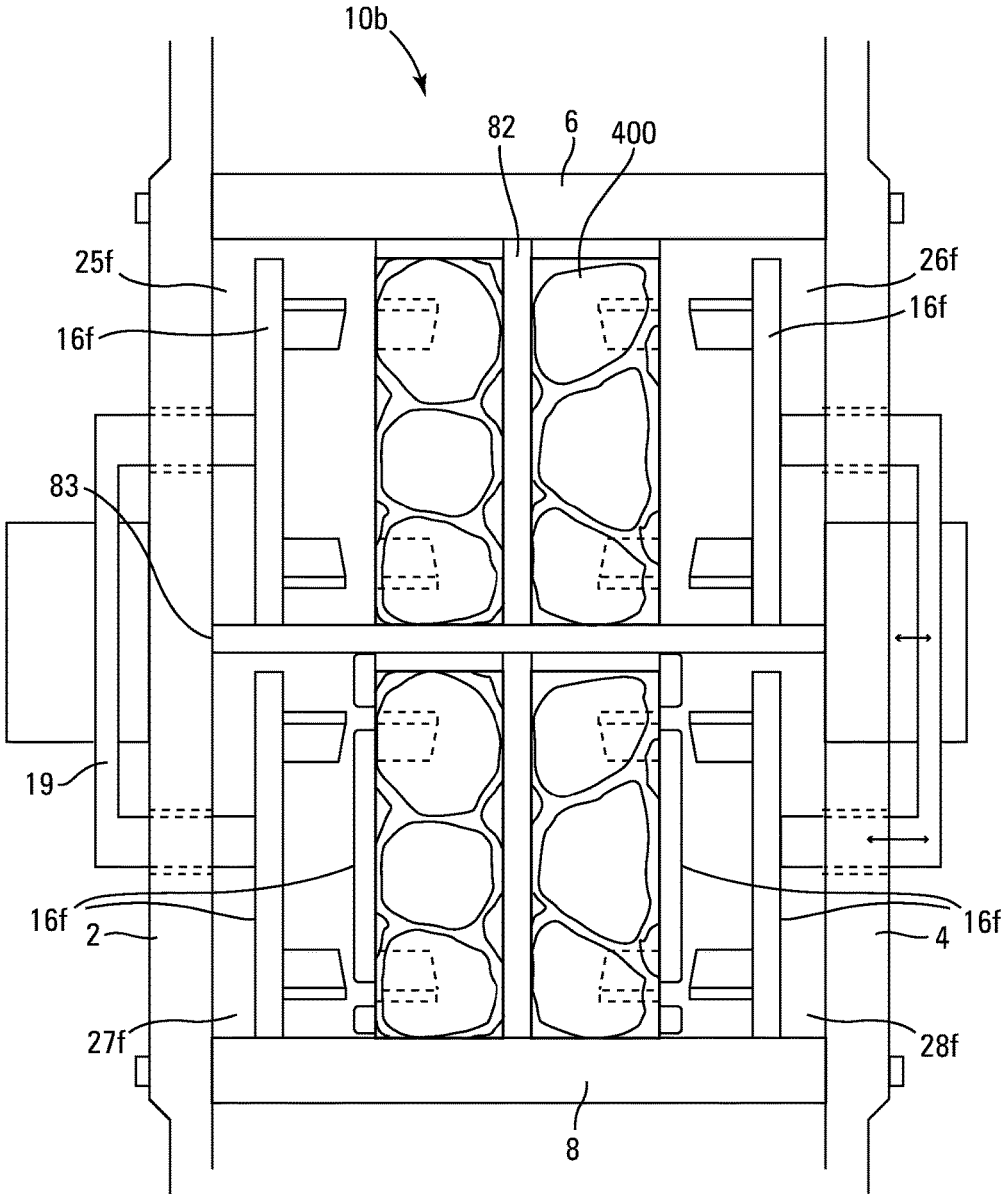
FIG. 74 shows multiple mold cavities for making blocks 400.

FIG. 74 is a top plan view of a multi-block mold box 10*b* for making the blocks described herein. Specifically, the mold has been adapted to make blocks 400. During a block making process mold box 10*b* is configured to rest upon a pallet to form mold cavities 25*f*, 26*f*, 27*f* and 28*f*. Division liner 82, which is perpendicular to end walls 6 and 8, and division liner 83, which is perpendicular to side walls 2 and 4, form the four separate mold cavities 25*f*, 26*f*, 27*f* and 28*f*. Moveable means 19 moves side liners 16*f* which forms a groove in the mold of mold cavities 25*f*, 26*f*, 27*f* and 28*f*. Moveable side liner 16*f* may be comprised of one continuous liner piece that moves as a whole, as seen in mold cavities 25*f* and 26*f*. Additionally and/or alternatively, moveable side liner 16*f* may be comprised of separate liner pieces, a stationary section with two openings that allow two moveable groove forming members to travel into and out of the mold cavity as shown in mold cavities 27*f* and 28*f*.

Figure 75:
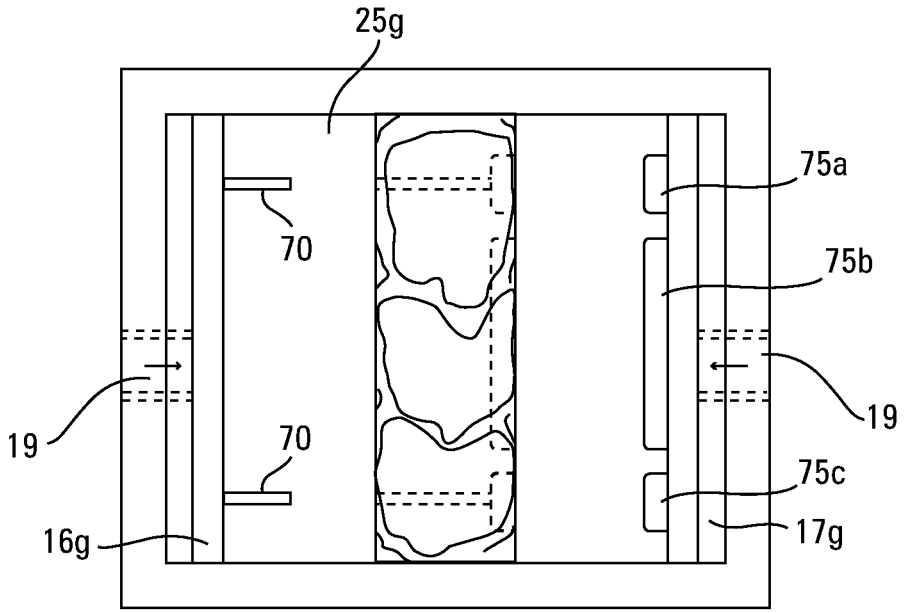
FIG. 75 shows a mold cavity for making an embodiment of blocks of the present invention.
Figure 76:
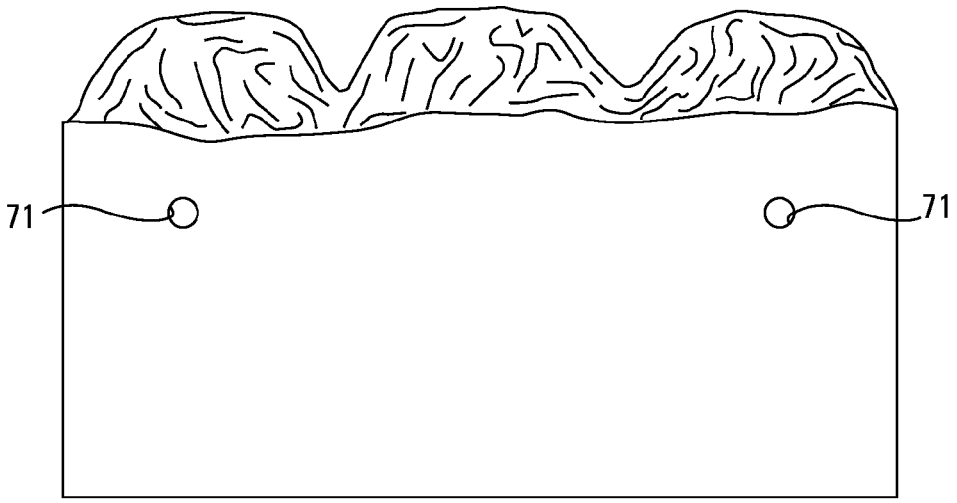
FIGS. 76 and 77 are top and bottom views of a block made from the mold cavity of FIG. 75.
Figure 77:
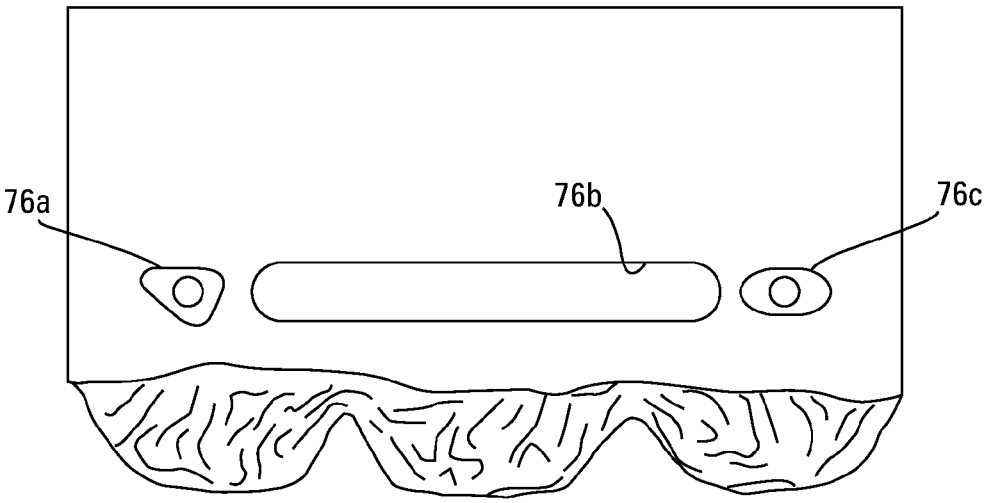

FIG. 75 is a top plan view of a mold cavity for making the blocks of FIGS. 76 and 77. Mold cavity 25*g* has moveable means 19 which move side liners 16*g* and 17*g*. Side liner 16*g* has pin hole molding elements 70 which form pin holes 71 in the block as shown in FIG. 76. The pin holes formed in the mold, as seen in dashed lines in FIG. 75, may extend through the entirety of the mold (and thus the block being molded) from one surface to the opposed surface, or may extend only partially through the mold (and thus the block being molded) from one surface toward the opposing surface. Side liner 17*g* has pin receiving molding elements 75*a*, 75*b* and 75*c* which form pin receiving cavities 76*a*, 76*b* and 76*c*, respectively as shown in FIG. 77. The pin receiving cavities formed in the mold, as shown in dashed lines in FIG. 75, may extend through the entirety of the mold (and thus the block being molded) from one surface to the opposed surface, or may extend only partially through the mold (and thus the block being molded) from one surface toward the opposing surface. As shown in FIG. 77, the pin receiving cavity may have any shape, size or dimension (76*a* and 76*c* illustrating a couple of such shapes, sizes and dimensions) or may be a channel that may extend partially across the surface of the block (as shown by pin receiving cavity 76*b*) or may extend the entirety of the surface of the block from one side to the opposed side. The pin holes are designed to accept a shaft of a pin and the pin receiving cavities are designed to accept the head of a pin when utilizing a pinning system to construct a wall with the blocks of the present invention. It should be understood the pin holes and pin receiving cavities may be molded into any of the blocks disclosed herein.

Figure 78:
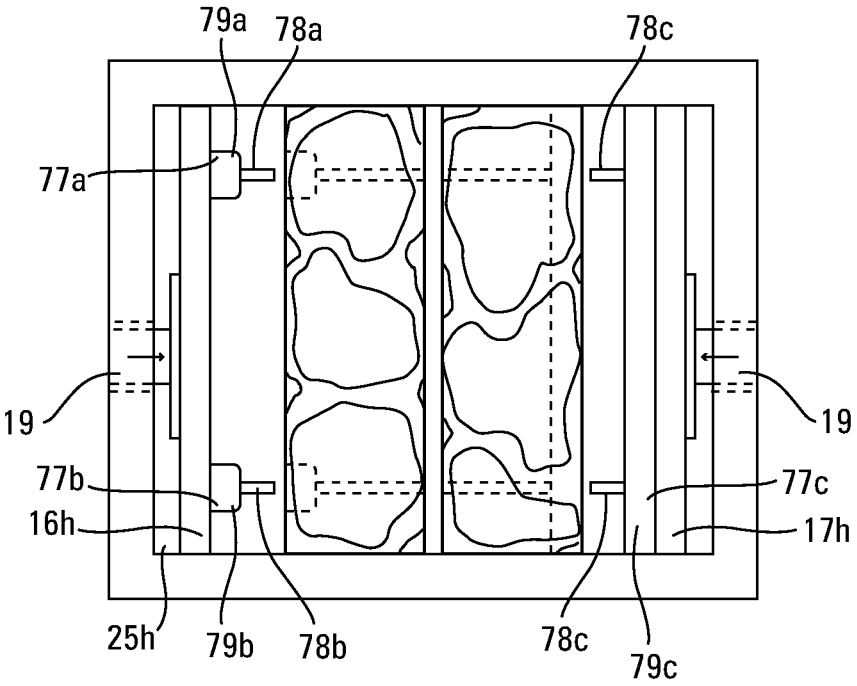
FIG. 78 shows a mold cavity for making the blocks of the present invention.
Figure 79:
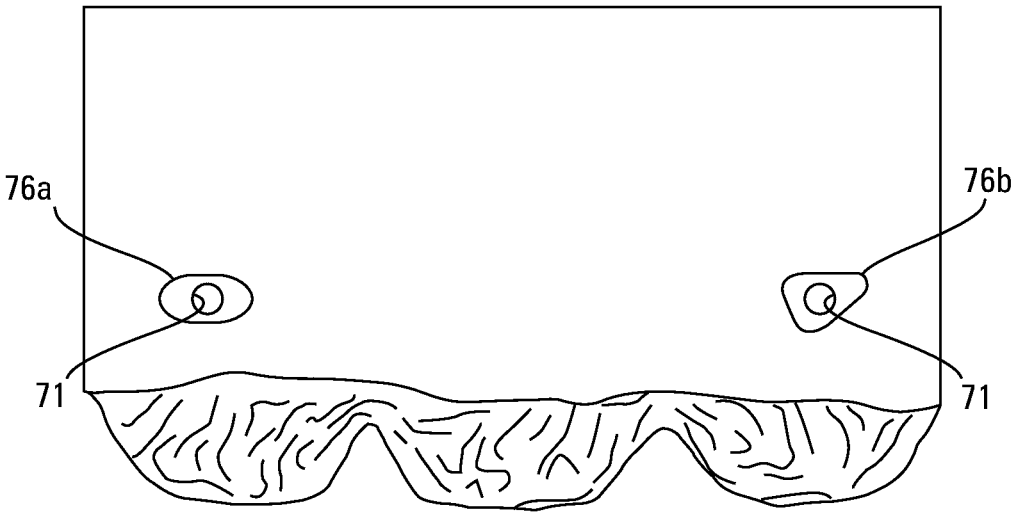
FIGS. 79 and 80 are views of an embodiment of blocks made from the mold cavity of FIG. 78.
Figure 80:
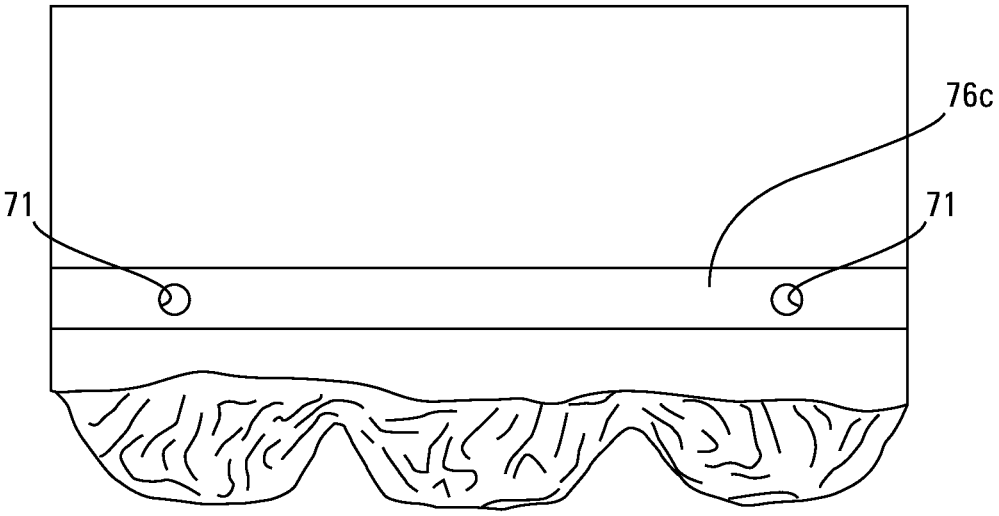

FIG. 78 is a top plan view of mold cavities for making the blocks of FIGS. 79 and 80. Mold cavity 25*h* has moveable means 19 which moves side liner 16*h* that has molding element 77*a* having pin hole forming portion 78*a* and pin receiving cavity forming portion 79*a* which form pin hole 71 and pin receiving cavity 76*a* in the block as shown in FIG. 79. Side liner 16*h* also has molding element 77*b* having pin hole forming portion 78*b* and pin receiving cavity forming portion 79*b* which form pin hole 71 and pin receiving cavity 76*b* in the block as shown in FIG. 80. Mold cavity 25*h* also has another moveable means 19 which moves side liner 17*h* that has molding element 77*c* having pin hole forming portions 78*c* and pin receiving channel forming portion 79*c* which form pin holes 71 and pin receiving channel 76*c* in the block as shown in FIG. 80. The pin holes, pin receiving channel and/or pin receiving cavities formed in the mold and shown in dashed lines in FIG. 78, may extend only partially through the mold from one surface toward the opposing surface and thus may be closed at the opposed side of the block opposite the pin hole opening or may be open to both opposing surfaces. The pin holes, pin receiving cavities and/or pin receiving channels may have any shape, size or dimension as and may be molded into any of the blocks disclosed herein.

The invention provides a wall block comprising: a block body having opposed front and rear faces, opposed and substantially parallel top and bottom surfaces, and opposed first and second side walls, the first and second side walls each having a vertically planar first portion adjacent the top surface and a vertically planar second portion adjacent the bottom surface, the first and second portion of each side wall extending from the front face to the rear face, the first portion of the first side wall and the first portion of the second side wall converging from the front face toward the rear face along the top surface of the block and the second portion of the first side wall and the second portion of the second side wall being substantially parallel to each other along the bottom surface of the block. The top surface has a substantially trapezoidal shape with boundaries formed by the opposed front and rear faces and the opposed and converging first portion of the first and second side walls and the bottom surface has a substantially rectangular shape with boundaries formed by the front and rear faces and the opposed and substantially parallel second portion of the first and second side walls and wherein the trapezoidal shaped top surface has a total surface area that is less than the total surface area of the rectangular shaped bottom surface.

In an embodiment, the second portion of the first and second side walls have an upper horizontally planar surface extending outward from the first portion of the first and second side walls. In one embodiment, the first and second side walls have a break-away groove that extends into the block body below the vertically planar first portion of the first and second side walls and is partially formed by the upper horizontally planar surface of the second portion of the first and second side walls.

In an embodiment, the front face has a first undercut portion adjacent the top surface and a second undercut portion adjacent the bottom surface, the first and second undercut portions being separated by a molded surface having an irregular contour which is non-planar horizontally and vertically. In one embodiment, more than one section of the second undercut portion extends outwardly from the bottom surface, the more than one section of the second portion having an average upward angular slope between the bottom surface and the molded surface that is less than 90°. In an embodiment, at least one section of the second undercut portion extends inwardly from the bottom surface, the at least one section of the first undercut portion having an upward angle greater than 90°. In one embodiment, the first undercut portion is irregularly contoured along the top surface of the block, the irregular contour having first sections extending outward away from the rear face of the block and second sections extending inwardly towards the rear face of the block. In an embodiment, the second undercut portion is irregularly contoured along the bottom surface of the block, the irregular contour having first sections extending outward away from the rear face of the block and second sections extending inwardly towards the rear face of the block.

The invention provides a wall block system comprising: a plurality of blocks having a block body with opposed front and rear faces, opposed and substantially parallel top and bottom surfaces, and opposed first and second side walls, the first and second side walls each having a vertically planar first portion adjacent the top surface and a vertically planar second portion adjacent the bottom surface, the first and second portion of each side wall extending from the front face to the rear face, the first portion of the first side wall and the first portion of the second side wall converging from the front face toward the rear face along the top surface of the block and the second portion of the first side wall and the second portion of the second side wall being substantially parallel to each other along the bottom surface of the block, the top surface having a trapezoidal shape with boundaries formed by the opposed front and rear faces and the opposed and converging first portion of the first and second side walls and the bottom surface having a rectangular shape with boundaries formed by the opposed front and rear faces and the opposed and substantially parallel second portion of the first and second side walls, the trapezoidal shaped top surface having a total surface area that is less than the total surface area of the rectangular shaped bottom surface. The second portion of the first and second side walls have an upper horizontally planar surface extending outward from the first portion of the first and second side walls.

In an embodiment, the first and second side walls have a break-away groove that extends into the block body below the vertically planar first portion of the first and second side walls and is partially formed by the upper horizontally planar surface of the second portion of the first and second side walls. In one embodiment, the second portion of the first and second side walls of the plurality of blocks has a lower horizontally planar surface that is located directly below the upper horizontally planar surface and is part of the bottom surface of the block. In an embodiment, the upper horizontally planar surface, lower horizontally planar surface and second portion of the side wall form a break-away portion that is detached from at least one of the first and second side walls of at least one of the plurality of blocks.

In an embodiment, the break-away portion is detached from both of the first and second side walls of at least one of the plurality of blocks. In one embodiment, when the blocks are stacked in at least a lower course and an upper course to form a wall, at least some of the blocks are positioned adjacent to a block having at least one detached break-away portion. In an embodiment, the uppermost course of blocks that are stacked to form a structure are positioned with the bottom surface facing upward to create a gapless capping course.

The invention provides a block system comprising: a plurality of blocks having a block body with opposed front and rear faces, opposed and substantially parallel top and bottom surfaces, and opposed first and second side walls, the first and second side walls each having a vertically planar first portion adjacent the top surface and a vertically planar second portion adjacent the bottom surface, the first and second portion of each side wall extending from the front face to the rear face, the first portion of the first side wall and the first portion of the second side wall converging from the front face toward the rear face along the top surface of the block and the second portion of the first side wall and the second portion of the second side wall being substantially parallel to each other along the bottom surface of the block, the top surface having a trapezoidal shape with boundaries formed by the opposed front and rear faces and the opposed and converging first portion of the first and second side walls and the bottom surface having a rectangular shape with boundaries formed by the opposed front and rear faces and the opposed and substantially parallel second portion of the first and second side walls, the trapezoidal shaped top surface having a total surface area that is less than the total surface area of the rectangular shaped bottom surface. The front face has a first undercut portion adjacent the top surface and a second undercut portion adjacent the bottom surface, the first and second undercut portions being separated by a molded surface having an irregular contour which is non-planar horizontally and vertically.

In an embodiment, the blocks are configured such that when the blocks are stacked in at least first and second courses to form a wall having a setback in the range of ¼ inch to 1 inch from course to course, in a top view of the wall the top planar surface of blocks in the first course is not exposed. In one embodiment, more than one section of the second undercut portion extends outwardly from the bottom surface, the more than one section of the second portion having an average upward angular slope between the bottom surface and the molded surface that is less than 90°. In an embodiment, at least one section of the second undercut portion extends inwardly from the bottom surface, the at least one section of the first undercut portion having an upward angle greater than 90°. In one embodiment, the first undercut portion is irregularly contoured along the top surface of the block, the irregular contour having first sections extending outward away from the rear face of the block and second sections extending inwardly towards the rear face of the block.

It should be understood that the mold box could be configured to impart any desired face shape, texture or pattern onto any or all side, front and back surfaces of the blocks. Although the blocks described above are shown with natural stone faces any other natural, geometric, regular or irregular pattern could be formed as desired. Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall block comprising:

a block body having opposed front and rear faces, opposed top and bottom surfaces, and opposed compound first and second side walls, the first and second compound side walls converging from the front face toward the rear face, the first side wall having at least a first projection, the first projection formed by first and second angular planar surfaces that extend from the front face toward the rear face along the first side wall, the first angular planar surface extending outward from the block body at a slope from a first inner surface on the first side wall and the second angular planar surface extending outward from the block body at a slope from a second inner surface on the first side wall, the second side wall having at least a first groove, the first groove formed by first and second angular planar surfaces that extend from the front face toward the rear face along the second side wall, the first angular planar surface extending inward towards the block body at a slope from a first outer surface of the second side wall and the second angular planar surface extending inward toward the block body at a slope from a second outer surface of the second side wall, wherein the first and second angular planar surfaces of the at least first projection of the first side wall form a first side irregularly contoured edge portion with the front face and the first and second angular planar surfaces of the at least one groove of the second side wall form a second side irregularly contoured edge portion with the front face and wherein the first projection of the first side wall is shaped and sized to be received in the first groove of the second side wall.

2. The wall block of claim 1, wherein the first side wall has at least a second projection, the second projection formed by third and fourth angular planar surfaces that extend outward from the block body along the first side wall.

3. The wall block of claim 2, wherein, the first side wall has at least a first groove, the first groove formed by one of the angular planar surfaces of the first projection and one of the angular planar surfaces of the second projection of the first side wall.

4. The wall block of claim 3, wherein the second side wall has at least a second groove, the second groove formed by third and fourth angular planar surfaces that extend inward toward the block body along the second side wall.

5. The wall block of claim 4, wherein, the second side wall has at least a first projection, the first projection formed by one of the angular planar surfaces of the first groove and one of the angular planar surfaces of the second groove of the second side wall.

6. The wall block of claim 1, wherein the front face has a first undercut portion adjacent the top surface and a second undercut portion adjacent the bottom surface, the first and second undercut portions being separated by a molded surface having an irregular contour which is non-planar horizontally and vertically.

7. The wall block of claim 1, wherein the front face has a molded first side irregularly contoured edge, the first side irregularly contoured edge having at least a portion that is recessed inward toward the block body from an outermost point of the front face and wherein the front face has a molded second side irregularly contoured edge, the second side irregularly contoured edge having at least a portion that is recessed inward toward the block body from an outermost point of the front face.

8. The wall block of claim 1, wherein the rear face has a receiving channel that extends from the first side wall to the second side wall.

9. The wall block of claim 1, wherein the first and second side walls each have a length, the at least one projection of the first side wall extending a partial length along the first side wall and the at least one groove of the second side wall extending a partial length along the second side wall.

10. The wall block of claim 1, wherein the first and second side walls each have a length, the at least one projection of the first side wall extending the entire length along the first side wall and the at least one groove of the second side wall extending the entire length along the second side wall.

11. A wall block system comprising:

a plurality of wall blocks having a block body with opposed front and rear faces, opposed top and bottom surfaces, and opposed compound first and second side walls, the first and second compound side walls converging from the front face toward the rear face, the first side wall having at least a first projection, the first projection formed by first and second angular planar surfaces that extend from the front face toward the rear face along the first side wall, the first angular planar surface extending outward from the block body at a slope from a first inner surface on the first side wall and the second angular planar surface extending outward from the block body at a slope from a second inner surface on the first side wall, the second side wall having at least a first groove, the first groove formed by first and second angular planar surfaces that extend from the front face toward the rear face along the second side wall, the first angular planar surface extending inward towards the block body at a slope from a first outer surface of the second side wall and the second angular planar surface extending inward toward the block body at a slope from a second outer surface of the second side wall, wherein the first and second angular planar surfaces of the at least first projection of the first side wall form a first side irregularly contoured edge portion with the front face and the first and second angular planar surfaces of the at least one groove of the second side wall form a second side irregularly contoured edge portion with the front face and wherein when the blocks are stacked in at least a lower course and an upper course to form a wall, the projection of the first side wall of a first wall block is shaped and sized to be received in the groove of the second side wall of an adjacently positioned second wall block in a course of blocks.

12. The wall block system of claim 11, wherein the first side wall has at least a second projection, the second projection formed by third and fourth angular planar surfaces that extend outward from the block body along the first side wall.

13. The wall block system of claim 12, wherein, the first side wall has at least a first groove, the first groove formed by one of the angular planar surfaces of the first projection and one of the angular planar surfaces of the second projection of the first side wall.

14. The wall block system of claim 13, wherein the second side wall has at least a second groove, the second groove formed by third and fourth angular planar surfaces that extend inward toward the block body along the second side wall.

15. The wall block system of claim 14, wherein, the second side wall has at least a first projection, the first projection formed by one of the angular planar surfaces of the first groove and one of the angular planar surfaces of the second groove of the second side wall.

16. The wall block system of claim 15, wherein the projection of the second side wall of a first wall block is shaped and sized to be received in the groove of the first side wall of an adjacently positioned second wall block in a course of blocks.

17. The wall block system of claim 11, wherein the front face has a first undercut portion adjacent the top surface and a second undercut portion adjacent the bottom surface, the first and second undercut portions being separated by a molded surface having an irregular contour which is non-planar horizontally and vertically.

18. The wall block system of claim 11, wherein the front face has a molded first side irregularly contoured edge, the first side irregularly contoured edge having at least a portion that is recessed inward toward the block body from an outermost point of the front face and wherein the front face has a molded second side irregularly contoured edge, the second side irregularly contoured edge having at least a portion that is recessed inward toward the block body from an outermost point of the front face.

19. The wall block system of claim 11, wherein the rear face has a receiving channel that extends from the first side wall to the second side wall.

20. A mold assembly for producing wall blocks having a block body with opposed front and rear faces, opposed top and bottom surfaces, and opposed compound first and second side walls, the first and second compound side walls converging from the front face toward the rear face, the first side wall having at least a first projection, the first projection formed by first and second angular planar surfaces that extend from the front face toward the rear face along the first side wall, the first angular planar surface extending outward from the block body at a slope from a first inner surface on the first side wall and the second angular planar surface extending outward from the block body at a slope from a second inner surface on the first side wall, the first and second projecting surfaces of the first side wall forming a first side irregularly contoured edge portion with the front face, the second side wall having at least a first groove, the first groove formed by first and second angular planar surfaces that extend from the front face toward the rear face along the second side wall, the first angular planar surface extending inward towards the block body at a slope from a first outer surface of the second side wall and the second angular planar surface extending inward toward the block body at a slope from a second outer surface of the second side wall, the first and second recessing surfaces of the second side wall form a second side irregularly contoured edge portion with the front face, the first projection of the first side wall being shaped and sized to be received in the first groove of the second side wall, the mold assembly comprising:

a production pallet;

a stripper shoe; and a mold box including first and second opposed side walls that are moveable from a disengaged mold stripping position to an engaged molding position during a block forming process, and opposed front and rear walls which together with the first and second side walls form a perimeter of at least one mold cavity shaped to form a block during a block forming process, the mold box having an open top and an open bottom, the production pallet enclosing the open bottom of the mold box during a block forming process, the stripper shoe enclosing at least a portion of the open top of the mold box during a block forming process, the stripper shoe having a contoured molding surface shaped for forming the front face of a block, the moveable first side wall of the mold assembly having a molding surface that forms the first side wall of the block, and the moveable second side wall of the mold assembly having a molding surface that forms the second side wall of the block.

* * * * *